US012704134B2

(12) United States Patent
Deshpande et al.

(10) Patent No.: US 12,704,134 B2
(45) Date of Patent: Aug. 11, 2026

(54) MINIMIZING MIXING IN A PRESSURE EXCHANGER

(71) Applicant: Energy Recovery, Inc., San Leandro, CA (US)

(72) Inventors: Chinmay Vishwas Deshpande, Fremont, CA (US); Omprakash Samudrala, San Ramon, CA (US); Sujan Reddy Gudigopuram, San Ramon, CA (US); Alexander Patrick Theodossiou, Alameda, CA (US); Teymour Javaherchi, Piedmont, CA (US); Anthony Kim Phan, San Jose, CA (US)

(73) Assignee: Energy Recovery, Inc., San Leandro, CA (US)

( * ) Notice: Subject to any disclaimer, the term of this patent is extended or adjusted under 35 U.S.C. 154(b) by 251 days.

(21) Appl. No.: 18/125,334

(22) Filed: Mar. 23, 2023

(65) Prior Publication Data

US 2023/0323900 A1 Oct. 12, 2023

Related U.S. Application Data

(60) Provisional application No. 63/395,694, filed on Aug. 5, 2022, provisional application No. 63/388,991, filed (Continued)

(51) Int. Cl.
*F04F 13/00* (2009.01)
*F04B 53/16* (2006.01)

(52) U.S. Cl.
CPC ..... *F04F 13/00* (2013.01); *F04B 53/16* (2013.01)

(58) Field of Classification Search
CPC ..... F04F 13/00; F04B 53/16

(Continued)

(56) References Cited

U.S. PATENT DOCUMENTS 2,526,618 A 10/1950 Georges
2,800,120 A 7/1957 Tihamer et al.

(Continued)

FOREIGN PATENT DOCUMENTS

DE 844231 C 7/1952
EP 2664801 A1 11/2013

(Continued)

OTHER PUBLICATIONS

International Search Report and Written Opinion for International Application No. PCT/US2023/016291, mailed Sep. 21, 2023, 21 Pages.

(Continued)

*Primary Examiner* — Charles G Freay
(74) *Attorney, Agent, or Firm* — Lowenstein Sandler LLP

(57) ABSTRACT

A pressure exchanger includes a rotor configured to exchange pressure between a first fluid at a first pressure and a second fluid at a second pressure. The rotor forms ducts that are routed from a first distal end to a second distal end. The pressure exchanger further includes a first end cover that forms a high pressure in (HPIN) port configured to provide the first fluid at the first pressure in a substantially axial direction into the ducts. The first end cover forms a low pressure out (LPOUT) port configured to receive the first fluid from the ducts at a third pressure. The pressure exchanger further includes a second end cover that forms a low pressure in (LPIN) port configured to provide the second fluid at the second pressure into the ducts and forms a high pressure out (HPOUT) port configured to receive the second fluid from the ducts at a fourth pressure.

20 Claims, 24 Drawing Sheets

Related U.S. Application Data on Jul. 13, 2022, provisional application No. 63/323,462, filed on Mar. 24, 2022.

(58) Field of Classification Search
USPC ..... 417/64
See application file for complete search history.

(56) References Cited

U.S. PATENT DOCUMENTS

| | | | | |
|---|---|---|---|---|
| 2,946,184 | A | 7/1960 | Boszormenyi et al. | |
| 3,012,708 | A | 12/1961 | Max et al. | |
| 3,109,580 | A * | 11/1963 | Kentfield | F02B 33/42 417/64 |
| 3,120,919 | A | 2/1964 | Gardiner | |
| 3,234,736 | A | 2/1966 | Brian | |
| 4,274,811 | A | 6/1981 | Rao | |
| 4,360,317 | A * | 11/1982 | Vallance | F04F 13/00 417/64 |
| 4,887,942 | A | 12/1989 | Hauge | |
| 5,052,362 | A * | 10/1991 | Jenny | F02B 33/42 60/602 |
| 6,537,035 | B2 * | 3/2003 | Shumway | F04F 13/00 417/64 |
| 6,773,226 | B2 | 8/2004 | Al-Hawaj | |
| 7,201,557 | B2 | 4/2007 | Stover | |
| 7,661,932 | B2 | 2/2010 | El-Sayed et al. | |
| 7,997,853 | B2 | 8/2011 | Pique et al. | |
| 8,075,281 | B2 | 12/2011 | Martin et al. | |
| 9,695,795 | B2 | 7/2017 | Martin et al. | |
| 9,885,372 | B2 | 2/2018 | Arluck et al. | |
| 10,125,796 | B2 | 11/2018 | Hauge | |
| 10,138,907 | B2 | 11/2018 | Pinto et al. | |
| 2006/0245909 | A1 | 11/2006 | Stover | |
| 2009/0104046 | A1 | 4/2009 | Martin et al. | |
| 2010/0196152 | A1 | 8/2010 | Pique et al. | |
| 2013/0121850 | A1 | 5/2013 | Pinto et al. | |
| 2013/0280038 | A1 * | 10/2013 | Martin | F04F 13/00 415/110 |
| 2013/0294944 | A1 | 11/2013 | Hirosawa et al. | |
| 2014/0048143 | A1 | 2/2014 | Lehner et al. | |
| 2015/0050163 | A1 | 2/2015 | Sigurdsson | |
| 2015/0050177 | A1 | 2/2015 | Sigurdsson | |
| 2015/0096739 | A1 | 4/2015 | Ghasripoor et al. | |
| 2015/0184502 | A1 | 7/2015 | Krish et al. | |
| 2015/0292310 | A1 | 10/2015 | Ghasripoor et al. | |
| 2016/0160881 | A1 | 6/2016 | Anderson et al. | |
| 2016/0160882 | A1 | 6/2016 | Morphew | |
| 2016/0160888 | A1 | 6/2016 | Morphew | |
| 2016/0160890 | A1 | 6/2016 | Anderson | |
| 2019/0145237 | A1 | 5/2019 | Shampine | |
| 2019/0257323 | A1 | 8/2019 | Shampine | |
| 2019/0277110 | A1 | 9/2019 | Shampine | |
| 2020/0141444 | A1 | 5/2020 | Thatte et al. | |
| 2021/0123551 | A1 | 4/2021 | Kuhn De Chizelle et al. | |
| 2021/0246910 | A1 | 8/2021 | Hauge | |
| 2023/0008069 | A1 | 1/2023 | McLean, Jr. et al. | |

FOREIGN PATENT DOCUMENTS

| | | | |
|---|---|---|---|
| EP | 3090187 | A2 | 11/2016 |
| EP | 3635260 | A1 | 4/2020 |
| GB | 775271 | A | 5/1957 |
| GB | 840408 | A | 7/1960 |
| GB | 920908 | A | 3/1963 |
| GB | 1384959 | A | 2/1975 |
| WO | 2008042693 | A1 | 4/2008 |
| WO | 2009046429 | A2 | 4/2009 |
| WO | 2011079045 | A2 | 6/2011 |

OTHER PUBLICATIONS

International Search Report and Written Opinion for International Application No. PCT/US2023/016293, mailed Jun. 13, 2023, 18 Pages.

International Search Report and Written Opinion for International Application No. PCT/US2023/016296, mailed Jun. 13, 2023, 16 Pages.

International Search Report and Written Opinion for International Application No. PCT/US2023/16310, mailed Aug. 21, 2023, 25 Pages.

"Definition of Axial," Merriam-Webster, Retrieved on Nov. 8, 2024, pp. 1-5, Retrieved from [https://www.merriam-webster.com/dictionary/axial].

"Definition of Loft," Merriam Webster, Retrieved on Nov. 7, 2024, pp. 1-7, Retrieved from [https://www.merriam-webster.com/dictionary/loft].

"Definition of PVC," Dictionary, Retrieved on Nov. 6, 2024, pp. 1-3, Retrieved from [https://www.dictionary.com/browse/pvc].

Extended European Search Report for European Application No. 23775749.7 mailed Feb. 24, 2025, 8 Pages.

Extended European Search Report for European Application No. 24220617.5, mailed Feb. 20, 2025, 10 Pages.

Extended European Search Report for European Application No. 24220661.3, mailed Feb. 20, 2025, 9 Pages.

* cited by examiner

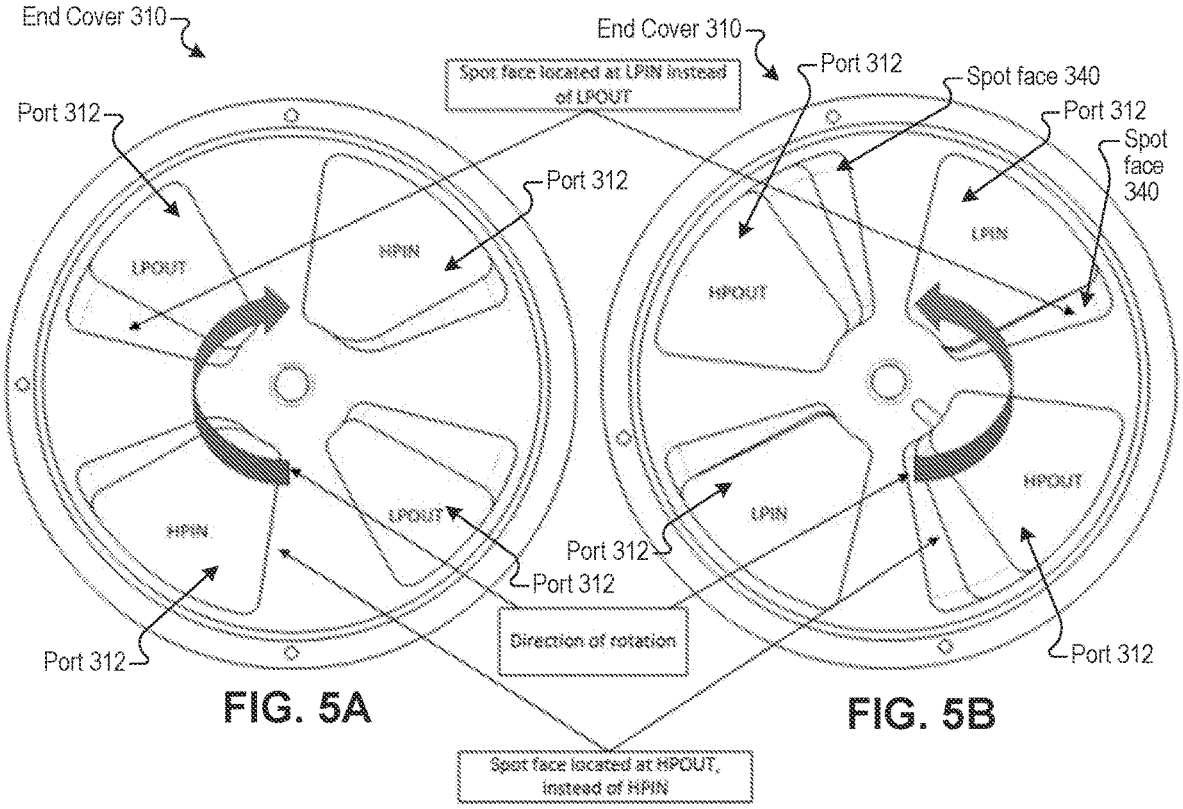
FIG. 5A
FIG. 5B
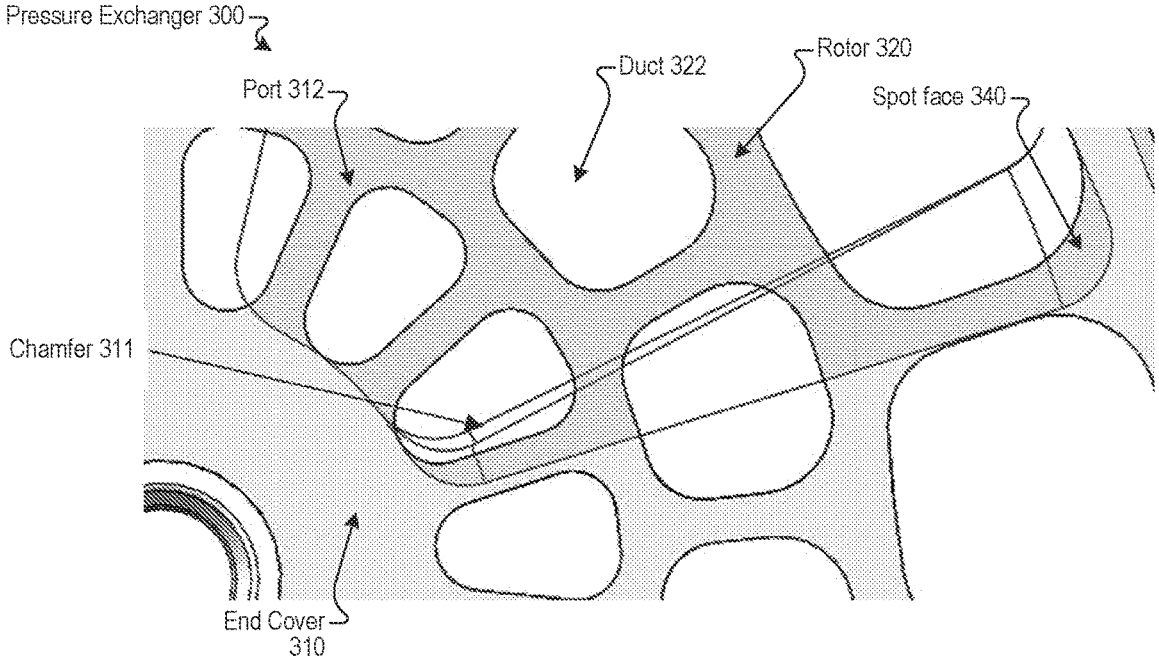
FIG. 5C

MINIMIZING MIXING IN A PRESSURE EXCHANGER

RELATED APPLICATIONS

This application claims benefit of U.S. Provisional Application No. 63/395,694, filed Aug. 5, 2022, U.S. Provisional Application 63/388,991, filed Jul. 13, 2022, and U.S. Provisional Application No. 63/323,462, filed Mar. 24, 2022, the entire contents of which are incorporated herein by reference.

TECHNICAL FIELD

The present disclosure relates to pressure exchangers, and, more particularly, minimizing mixing in pressure exchangers.

BACKGROUND

Pressure exchangers exchange pressure between a fluids. Mixing of the fluids may occur.

BRIEF DESCRIPTION OF THE DRAWINGS

The present disclosure is illustrated by way of example, and not by way of limitation in the figures of the accompanying drawings.

FIGS. 5A-J illustrate components of pressure exchangers, according to certain embodiments.

DETAILED DESCRIPTION OF EMBODIMENTS

Figure 1A:
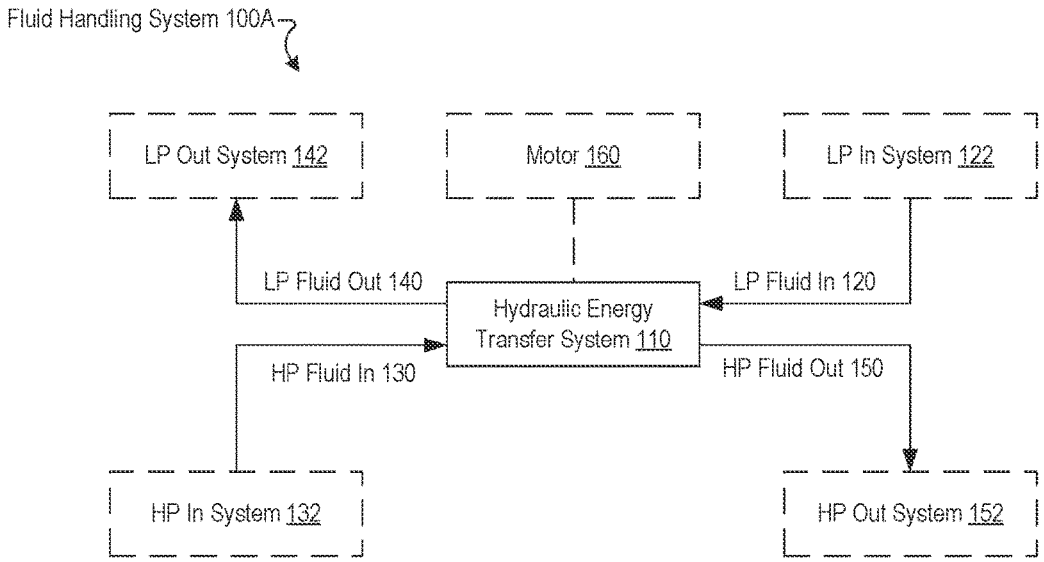
FIGS. 1A-D illustrate schematic diagrams of fluid handling systems including hydraulic energy transfer systems, according to certain embodiments.

Embodiments described herein are related to optimizing pressure exchangers by one or more of minimizing mixing, enhancing efficiency, cavitation control, noise control, and/or vibration control.

High pressure fluid may be used by systems, such as hydraulic fracturing (e.g., fracking or fracing) systems, desalinization systems, refrigeration systems, mud pumping systems, etc. Pumps may be used to provide the high pressure fluid. Certain fluids (e.g., brine, viscous fluids, sand, powder, debris, ceramics, etc.) may damage and reduce efficiency of pumps. A pressure exchanger may be used to exchange pressure between two fluids. A pump may be used to increase the pressure of a first fluid (e.g., substantially solid particle free, less viscous, water, etc.). A pressure exchanger may receive the high pressure first fluid (e.g., water) and a low pressure second fluid (e.g., fluid containing solid particles, fluid that is more viscous, brine) and may transfer the pressure from the high pressure first fluid to the low pressure second fluid.

In a pressure exchanger, liquid-to-liquid pressure exchange make take place via an oscillating "fluid plug" in the rotor ducts. The "fluid plug" is not impermeable and mixing can occur between the two fluids that are exchanging pressure energy. Mixing may be dependent on multiple factors such as travel distance of the "fluid plug" (e.g., portion of the rotor duct that the "fluid plug" traverses, distance the "fluid plug" travels inside the rotor duct over one revolution normalized rotor length), turbulence, diffusion, jetting, rotor entry and exit losses, etc. Efficiency of a pressure exchanger may be directly proportional to the travel distance of the "fluid plug," whereas pressure exchanger mixing may be inversely proportional to the travel distance. Conventional attempts to increase efficiency of the pressure exchanger by increasing travel distance also increase mixing inside the pressure exchanger. Less efficient pressure exchangers use more energy and cause other components (e.g., pumps) to be used more and to be worn down more. Pressure exchangers that mix fluids cause increased specific energy consumption (e.g., in a sea water reverse osmosis (SWRO) plant), cause contamination of fluid (e.g., when performing pressure exchange with toxic fluid, fluid with solid particles, more viscous fluid, etc.), cause wearing down of components (e.g., wearing down pumps due to solid particles being introduced into the water), etc.

In pressure exchangers (e.g., rotary isobaric pressure exchangers), rotating ducts carry high pressure (HP) fluids from HP ports (e.g., kidneys) to low pressure (LP) ports and also LP fluids from LP ports to HP ports. The duct fluids undergo rapid pressurization or depressurization when the duct fluids approach a set of ports. The frequency and the rate of pressurization or depressurization depends on the rotor revolutions per minute (RPM), number of pressure exchange cycles per revolution, and the pressure differential between HP and LP ports. The rapid pressurization and depressurization results in high velocity fluid jets generating noise and producing flow and pressure pulsations that increase vibration levels. This can also produce vapor bubbles if local fluid pressure (e.g., due to high velocity) falls below the vapor pressure at that temperature. The vapor bubbles collapse as the vapor bubbles travel to higher pressure regions which results in void formation which causes surrounding fluid to rush in producing very high localized pressure spikes. When occurring next to a solid wall, this produces pitting damage (e.g., cavitation), which accumulates over time. This cavitation further amplifies the noise and vibration levels.

The devices, systems, and methods of the present disclosure provide optimizing of a pressure exchanger for efficiency, mixing, cavitation, sound, and vibration.

A pressure exchanger includes a rotor configured to exchange pressure between a first fluid at a first pressure and a second fluid at a second pressure. The rotor forms ducts that are routed from a first distal end to a second distal end. The pressure exchanger further includes a first end cover that forms a high pressure in (HPIN) port configured to provide the first fluid at the first pressure into the ducts. The first end cover forms a low pressure out (LPOUT) port configured to receive the first fluid from the ducts at a third pressure. The pressure exchanger further includes a second end cover that forms a low pressure in (LPIN) port configured to provide the second fluid at the second pressure into the ducts and forms a high pressure out (HPOUT) port configured to receive the second fluid from the ducts at a fourth pressure.

In some embodiments, the HPIN port is configured to provide the first fluid at the first pressure in a substantially axial direction into the ducts. The first end cover may include one or more of: radial sidewalls that are closer to each other than radial sidewalls of the HPOUT port, a fillet between a radial sidewall and an inner sidewall, radial sidewalls that both form ramps, non-planar three-dimensional ramps, an insert, etc.

In some embodiments, one or more sidewalls (e.g., radial sidewalls) of the first end cover that form the HPIN port or the LPOUT port are substantially planar (e.g., not curved). In some embodiments, the rotor forms ducts in at least three concentric rows. In some embodiments, the pressure exchanger includes spacers disposed in the first end cover, where the spacers are disposed between interconnects (e.g., metal interconnects) and the first end cover (e.g., ceramic end cover).

In some embodiments, the second end cover forms a first spot face proximate the LPIN port and a second spot face proximate the HPOUT port. In some embodiments, the first end cover does not include spot faces 340 proximate the LPOUT port and the HPIN port. In some embodiments, the first and second spot faces 340 one or more of include a chamfer, include a radial extent that is shorter than a duct radial extent of a corresponding duct formed by the rotor, include different recesses for different concentric rows of the ducts, are staggered, etc. In some embodiments, the second end cover forms a pre-pressurization hole proximate the first spot face.

The present disclosure has advantages over conventional solutions. In some embodiments, pressure exchangers of the present disclosure exchange pressure at higher efficiencies compared to conventional systems. This provides for less energy usage and less use and wear of other components (e.g., pumps). In some embodiments, pressure exchangers of the present disclosure exchange pressure with less mixing of fluids compared to conventional systems. This provides for less specific energy consumption of plants, less contamination of fluids, less wearing down of components (e.g., pumps), etc. In some embodiments, pressure exchangers of the present disclosure generate less noise, have less vibration, and have less damage (e.g., pitting damage, cavitation) compared to conventional systems. This provides for less wear, less maintenance, less replacement of components, less downtime, etc.

Although some embodiments of the present disclosure are described in relation to the rotor and end covers of pressure exchangers, embodiments of the current disclosure can be applied to other components and other devices (e.g., adapter plates, etc.).

Although some embodiments of the present disclosure are described in relation to isobaric pressure exchangers, pressure exchangers, and hydraulic energy transfer systems, the current disclosure can be applied to other systems and devices (e.g., pressure exchanger that is not isobaric, rotating components that are not a pressure exchanger, a pressure exchanger that is not rotary, etc.).

Although some embodiments of the present disclosure are described in relation to exchanging pressure between fluid used in fracing systems, desalinization systems, and/or refrigeration systems, the present disclosure can be applied to other types of systems. Fluids can refer to liquid, gas, transcritical fluid, supercritical fluid, subcritical fluid, and/or combinations thereof.

Although some embodiments of the present disclosure are described in relation to a pressure exchanger that has a sleeve, in some embodiments, the pressure exchanger of the present disclosure is sleeved (e.g., has a sleeve) and in some embodiments, the pressure exchanger of the present disclosure is sleeve-less (e.g., does not have a sleeve, has a center-post).

Although some embodiments of the present disclosure are described in relation to a pressure exchanger that has a single cycle, in some embodiments, the pressure exchanger of the present disclosure is a multi-cycle pressure exchanger.

FIGS. 1A-D illustrate schematic diagrams of fluid handling systems 100A-D including hydraulic energy transfer systems 110 (e.g., pressure exchangers), according to certain embodiments.

Each hydraulic energy transfer system 110 of FIGS. 1A-D may include a pressure exchanger that includes a rotor configured to exchange pressure between a first fluid at a first pressure and a second fluid at a second pressure. The rotor forms ducts that are routed from a first distal end to a second distal end. The pressure exchanger further includes a first end cover that forms a high pressure in (HPIN) port configured to provide the first fluid at the first pressure into the ducts. The first end cover forms a low pressure out (LPOUT) port configured to receive the first fluid from the ducts at a third pressure. The pressure exchanger further includes a second end cover that forms a low pressure in (LPIN) port configured to provide the second fluid at the second pressure into the ducts and forms a high pressure out (HPOUT) port configured to receive the second fluid from the ducts at a fourth pressure.

In some embodiments, the hydraulic energy transfer system 110 of FIGS. 1A-D has a HPIN port that is configured to provide the first fluid at the first pressure in a substantially axial direction into the ducts of the rotor of the hydraulic energy transfer system 110. In some embodiments, one or more sidewalls (e.g., radial sidewalls) of the end cover that form the HPIN port or the LPOUT port are substantially planar (e.g., not curved). In some embodiments, the second end cover forms a first spot face proximate the LPIN port and a second spot face proximate the HPOUT port.

FIG. 1A illustrates a schematic diagram of a fluid handling system 100A including a hydraulic energy transfer system 110, according to certain embodiments.

In some embodiments, a hydraulic energy transfer system 110 includes a pressure exchanger (PX). The hydraulic energy transfer system 110 (e.g., PX) receives low pressure (LP) fluid in 120 (e.g., low-pressure inlet stream, low pressure in (LPIN)) from a LP in system 122. The hydraulic energy transfer system 110 also receives high pressure (HP) fluid in 130 (e.g., high-pressure inlet stream, high pressure in (HPIN)) from HP in system 132. The hydraulic energy transfer system 110 (e.g., PX) exchanges pressure between the HP fluid in 130 and the LP fluid in 120 to provide LP fluid out 140 (e.g., low-pressure outlet stream, low pressure out (LPOUT)) to LP fluid out system 142 and to provide HP fluid out 150 (e.g., high-pressure outlet stream, high pressure out (HPOUT)) to HP fluid out system 152.

In some embodiments, the hydraulic energy transfer system 110 includes a PX to exchange pressure between the HP fluid in 130 and the LP fluid in 120. The PX may be referred to as an isobaric pressure exchanger (IPX). The PX (e.g., an IPX) may be a device that transfers fluid pressure between HP fluid in 130 and LP fluid in 120 at efficiencies in excess of approximately 50%, 60%, 70%, 80%, 90%, or greater (e.g., without utilizing centrifugal technology, substantially isobaric pressure exchange). High pressure (e.g., HP fluid in 130, HP fluid out 150) refers to pressures greater than the low pressure (e.g., LP fluid in 120, LP fluid out 140). LP fluid in 120 of the PX may be pressurized and exit the PX at high pressure (e.g., HP fluid out 150, at a pressure greater than that of LP fluid in 120), and HP fluid in 130 may be depressurized and exit the PX at low pressure (e.g., LP fluid out 140, at a pressure less than that of the HP fluid in 130). The PX may operate with the HP fluid in 130 directly applying a force to pressurize the LP fluid in 120, with or without a fluid separator between the fluids. Examples of fluid separators that may be used with the PX include, but are not limited to, pistons, bladders, diaphragms and the like. In some embodiments, PXs may be rotary devices. Rotary PXs, such as those manufactured by Energy Recovery, Inc. of San Leandro, Calif., may not have any separate valves, since the effective valving action is accomplished internal to the device via the relative motion of a rotor with respect to end covers. Rotary PXs may be designed to operate with internal pistons to isolate fluids and transfer pressure with relatively little mixing of the inlet fluid streams. Reciprocating PXs may include a piston moving back and forth in a cylinder for transferring pressure between the fluid streams. Any PX or multiple PXs may be used in the present disclosure, such as, but not limited to, rotary PXs, reciprocating PXs, or any combination thereof. In addition, the PX may be disposed on a skid separate from the other components of a fluid handling system 100 (e.g., in situations in which the PX is added to an existing fluid handling system).

In some embodiments, a motor 160 is coupled to hydraulic energy transfer system 110 (e.g., to a PX). In some embodiments, the motor 160 controls the speed (e.g., RPM) of a rotor of the hydraulic energy transfer system 110 (e.g., to increase pressure of HP fluid out 150, to decrease pressure of LP fluid out 140, etc.). In some embodiments, motor 160 generates energy (e.g., acts as a generator) based on pressure exchanging in hydraulic energy transfer system 110.

The hydraulic energy transfer system 110 may be a hydraulic protection system (e.g., hydraulic buffer system, hydraulic isolation system) that may block or limit contact between fluid (e.g., solid particle laden fluid, frac fluid, viscous fluid, toxic fluid, etc.) and various equipment (e.g., hydraulic fracturing equipment, high-pressure pumps) while exchanging work and/or pressure with another fluid. By blocking or limiting contact between various equipment (e.g., fracturing equipment, pumps, etc.) and particular fluids (e.g., solid particle containing fluid), the hydraulic energy transfer system 110 increases the life and performance, while reducing abrasion, wear, contamination, etc., of various equipment (e.g., fracturing equipment, high pressure fluid pumps). Less expensive equipment may be used in the fluid handling system 100 by using equipment (e.g., high pressure fluid pumps) not designed for abrasive fluids (e.g., frac fluids and/or corrosive fluids).

The hydraulic energy transfer system 110 may include a hydraulic turbocharger or hydraulic pressure exchange system, such as a rotating PX. The PX may include one or more chambers (e.g., 1 to 100) to facilitate pressure transfer and equalization of pressures between volumes of first and second fluids (e.g., gas, liquid, multi-phase fluid). In some embodiments, the PX may transfer pressure between a first fluid (e.g., pressure exchange fluid, such as a proppant free or substantially proppant free fluid) and a second fluid that may be highly viscous and/or contain solid particles (e.g., frac fluid containing sand, proppant, powders, debris, ceramics). The solid particle fluid causes abrasion and/or erosion of components of the PX, such as the rotor and end covers of the PX. The fluid (e.g., abrasive particles in the fluid) may cause wear to an interface between the rotor and each end cover as the rotor rotates relative to the end covers. Replacing worn components of the PX may be costly.

The hydraulic energy transfer system 110 may be used in different types of systems, such as fracing systems, desalination systems, refrigeration systems, etc.

Figure 1B:
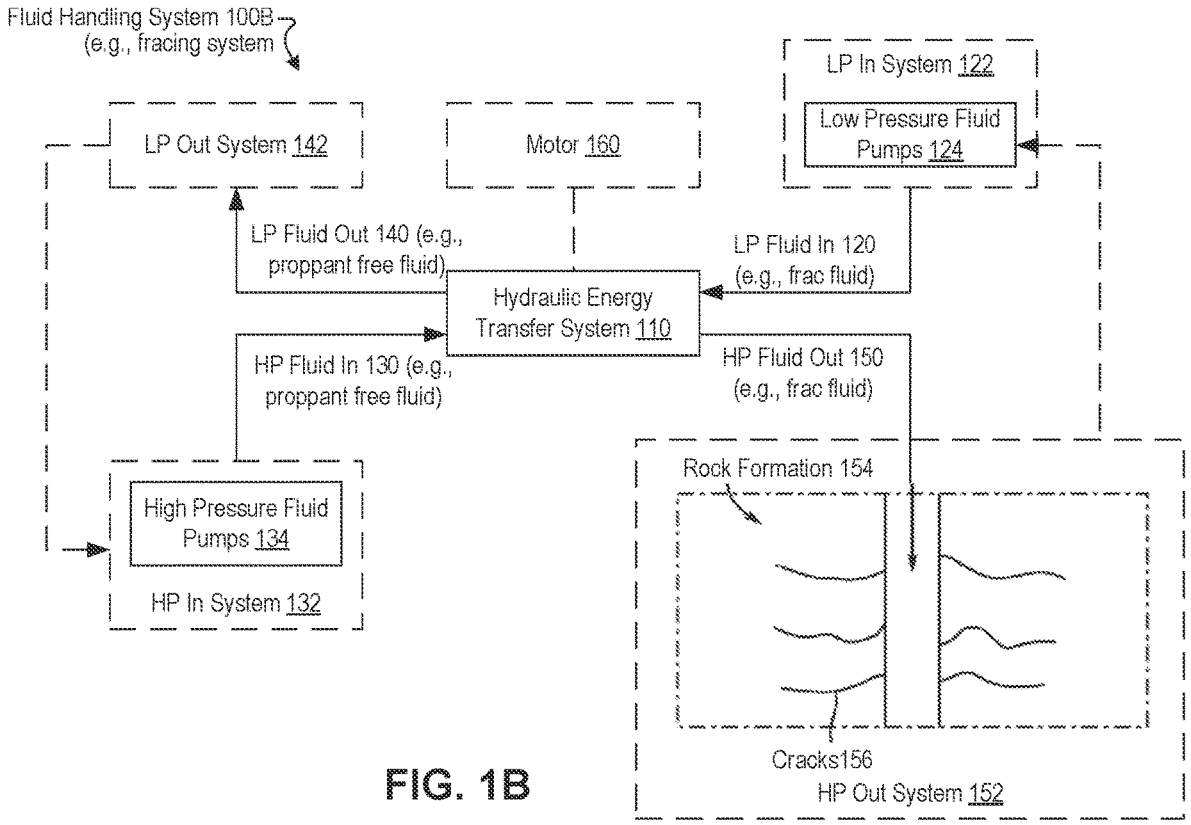

FIG. 1B illustrates a schematic diagram of a fluid handling system 100B including a hydraulic energy transfer system 110, according to certain embodiments. Features in FIG. 1B that have the same or similar reference numbers as features in FIG. TA may have the same or similar components, features, etc. as those in FIG. TA.

Fluid handling system 100B may be a fracing system (e.g., hydraulic fracturing system). In some embodiments, fluid handling system 100B includes more components, less components, same routing, different routing, and/or the like than that shown in FIG. 1B.

LP fluid in 120 and HP fluid out 150 may be frac fluid (e.g., fluid including solid particles, proppant fluid, etc.). HP fluid in 130 and LP fluid out 140 may be substantially solid particle free fluid (e.g., proppant free fluid, water, filtered fluid, etc.).

LP in system 122 may include one or more low pressure fluid pumps to provide LP fluid in 120 to the hydraulic energy transfer system 110 (e.g., PX). HP in system 132 may include one or more high pressure fluid pumps 134 to provide HP fluid in 130 to hydraulic energy transfer system 110.

Hydraulic energy transfer system 110 exchanges pressure between LP fluid in 120 (e.g., low pressure frac fluid) and HP fluid in 130 (e.g., high pressure water) to provide HP fluid out 150 (e.g., high pressure frac fluid) to HP out system 152 and to provide LP fluid out 140 (e.g., low pressure water). HP out system 152 may include a rock formation 154 (e.g., well) that includes cracks 156. The solid particles (e.g., proppants) from HP fluid out 150 may be provided into the cracks 156 of the rock formation.

In some embodiments, LP fluid out 140, high pressure fluid pumps 134, and HP fluid in 130 are part of a first loop (e.g., proppant free fluid loop). The LP fluid out 140 may be provided to the high pressure fluid pumps to generate HP fluid in 130 that becomes LP fluid out 140 upon exiting the hydraulic energy transfer system 110.

In some embodiments, LP fluid in 120, HP fluid out 150, and low pressure fluid pumps 124 are part of a second loop (e.g., proppant containing fluid loop). The HP fluid out 150 may be provided into the rock formation 154 and then pumped from the rock formation 154 by the low pressure fluid pumps 124 to generate LP fluid in 120.

In some embodiments, fluid handling system 100B is used in well completion operations in the oil and gas industry to perform hydraulic fracturing (e.g., fracking, fracing) to increase the release of oil and gas in rock formations 154. HP out system 152 may include rock formations 154 (e.g., a well). Hydraulic fracturing may include pumping HP fluid out 150 containing a combination of water, chemicals, and solid particles (e.g., sand, ceramics, proppant) into a well (e.g., rock formation 154) at high pressures. LP fluid in 120 and HP fluid out 150 may include a particulate laden fluid that increases the release of oil and gas in rock formations 154 by propagating and increasing the size of cracks 156 in the rock formations 154. The high pressures of HP fluid out 150 initiates and increases size of cracks 156 and propagation through the rock formation 154 to release more oil and gas, while the solid particles (e.g., powders, debris, etc.) enter the cracks 156 to keep the cracks 156 open (e.g., prevent the cracks 156 from closing once HP fluid out 150 is depressurized).

In order to pump this particulate laden fluid into the rock formation 154 (e.g., a well), the fluid handling system 100B may include one or more high pressure fluid pumps 134 and one or more low pressure fluid pumps 124 coupled to the hydraulic energy transfer system 110. For example, the hydraulic energy transfer system 110 may be a hydraulic turbocharger or a PX (e.g., a rotary PX). In operation, the hydraulic energy transfer system 110 transfers pressures without any substantial mixing between a first fluid (e.g., HP fluid in 130, proppant free fluid) pumped by the high pressure fluid pumps 134 and a second fluid (e.g., LP fluid in 120, proppant containing fluid, frac fluid) pumped bs the low pressure fluid pumps 124. In this manner, the hydraulic energy transfer system 110 blocks or limits wear on the high pressure fluid pumps 134, while enabling the fluid handling system 100B to pump a high-pressure frac fluid (e.g., HP fluid out 150) into the rock formation 154 to release oil and gas. In order to operate in corrosive and abrasive environments, the hydraulic energy transfer system 110 may be made from materials resistant to corrosive and abrasive substances in either the first and second fluids. For example, the hydraulic energy transfer system 110 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr. Ni, NiCr or Co.

In some embodiments, the hydraulic energy transfer system 110 includes a PX (e.g., rotary PX) and HP fluid in 130 (e.g., the first fluid, high-pressure solid particle free fluid) enters a first side of the PX where the TIP fluid in 130 contacts LP fluid in 120 (e.g., the second fluid, low-pressure frac fluid) entering the PX on a second side. The contact between the fluids enables the HP fluid in 130 to increase the pressure of the second fluid (e.g., LP fluid in 120), which drives the second fluid out (e.g., TIP fluid out 150) of the PX and down a well (e.g., rock formation 154) for fracturing operations. The first fluid (e.g., LP fluid out 140) similarly exits the PX, but at a low pressure after exchanging pressure with the second fluid. As noted above, the second fluid may be a low-pressure frac fluid that may include abrasive particles, which may wear the interface between the rotor and the respective end covers as the rotor rotates relative to the respective end covers.

Figure 1C:
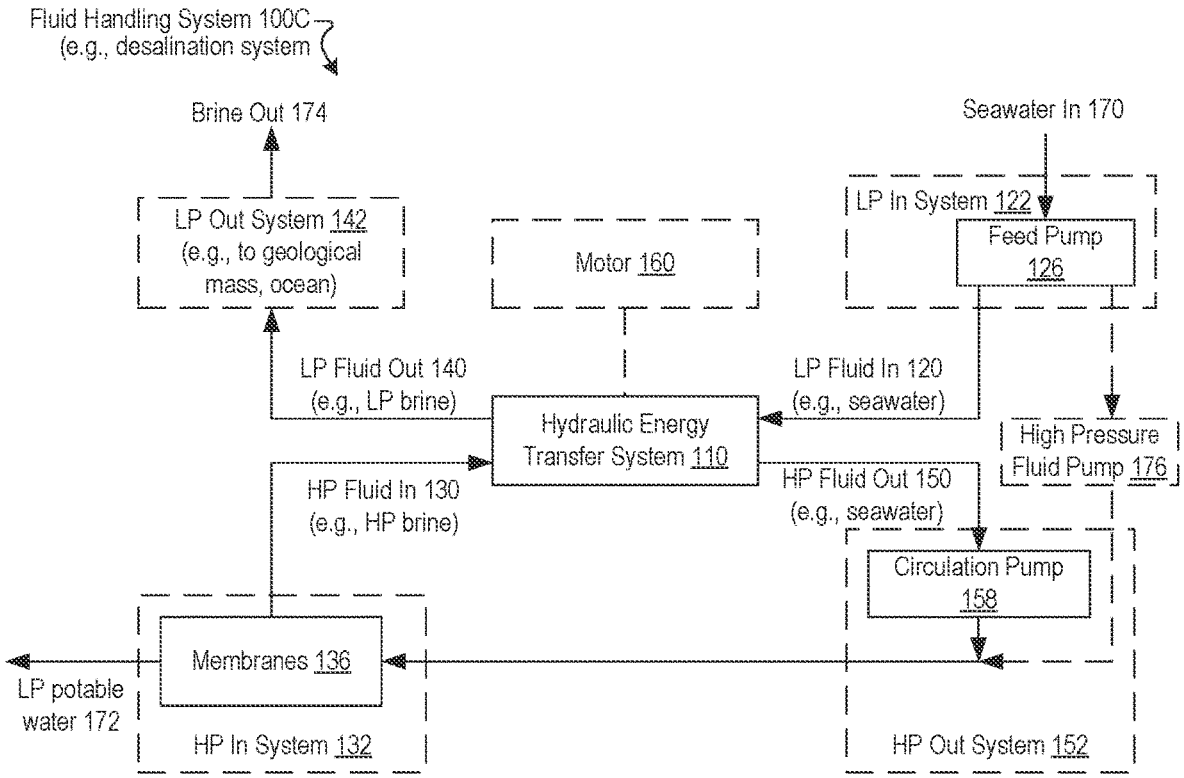

FIG. 1C illustrates a schematic diagram of a fluid handling system 100C including a hydraulic energy transfer system 110, according to certain embodiments. Fluid handling system 100C may be a desalination system (e.g., remove salt and/or other minerals from water). In some embodiments, fluid handling system 100C includes more components, less components, same routing, different routing, and/or the like than that shown in FIG. 1C.

LP in system 122 may include a feed pump 126 (e.g., low pressure fluid pump 124) that receives seawater in 170 (e.g., feed water from a reservoir or directly from the ocean) and provides LP fluid in 120 (e.g., low pressure seawater, feed water) to hydraulic energy transfer system 110 (e.g., PX). HP in system 132 may include membranes 136 that provide HP fluid in 130 (e.g., high pressure brine) to hydraulic energy transfer system 110 (e.g., PX). The hydraulic energy transfer system 110 exchanges pressure between the HP fluid in 130 and LP fluid in 120 to provide HP fluid out 150 (e.g., high pressure seawater) to HP out system 152 and to provide LP fluid out 140 (e.g., low pressure brine) to LP out system 142 (e.g., geological mass, ocean, sea, discarded, etc.).

The membranes 136 may be a membrane separation device configured to separate fluids traversing a membrane, such as a reverse osmosis membrane. Membranes 136 may provide HP fluid in 130 which is a concentrated feed-water or concentrate (e.g., brine) to the hydraulic energy transfer system 110. Pressure of the HP fluid in 130 may be used to compress low-pressure feed water (e.g., LP fluid in 120) to be high pressure feed water (e.g., HP fluid out 150). For simplicity and illustration purposes, the term feed water is used. However, fluids other than water may be used in the hydraulic energy transfer system 110. The hydraulic energy transfer system 110 can also be used for other applications, such as industrial waste water.

The circulation pump 158 (e.g., centrifugal pump) provides the HP fluid out 150 (e.g., high pressure seawater) to membranes 136. The membranes 136 filter the HP fluid out 150 to provide LP potable water 172 and HP fluid in 130 (e.g., high pressure brine). The LP out system 142 provides brine out 174 (e.g., to geological mass, ocean, sea, discarded, etc.).

In some embodiments, a high pressure fluid pump 176 is disposed between the feed pump 126 and the membranes 136. The high pressure fluid pump 176 increases pressure of the low pressure seawater (e.g., LP fluid in 120, provides high pressure feed water) to be mixed with the high pressure seawater provided by circulation pump 158.

In some embodiments, use of the hydraulic energy transfer system 110 decreases the load on high pressure fluid pump 176. In some embodiments, fluid handling system 100C provides LP potable water 172 without use of high pressure fluid pump 176. In some embodiments, fluid handling system 100C provides LP potable water 172 with intermittent use of high pressure fluid pump 176.

In some examples, hydraulic energy transfer system 110 (e.g., PX) receives LP fluid in 120 (e.g., low-pressure feed-water) at about 30 pounds per square inch (PSI) and receives HP fluid in 130 (e.g., high-pressure brine or concentrate) at about 980 PSI. The hydraulic energy transfer system 110 (e.g., PX) transfers pressure from the high-pressure concentrate (e.g., HP fluid in 130) to the low-pressure feed-water (e.g., LP fluid in 120). The hydraulic energy transfer system 110 (e.g., PX) outputs HP fluid out 150 (e.g., high pressure (compressed) feed-water) at about 965 PSI and LP fluid out 140 (e.g., low-pressure concentrate) at about 15 PSI. Thus, the hydraulic energy transfer system 110 (e.g., PX) may be about 97% efficient since the input volume is about equal to the output volume of the hydraulic energy transfer system 110 (e.g., PX), and 965 PSI is about 97% of 980 PSI.

Figure 1D:
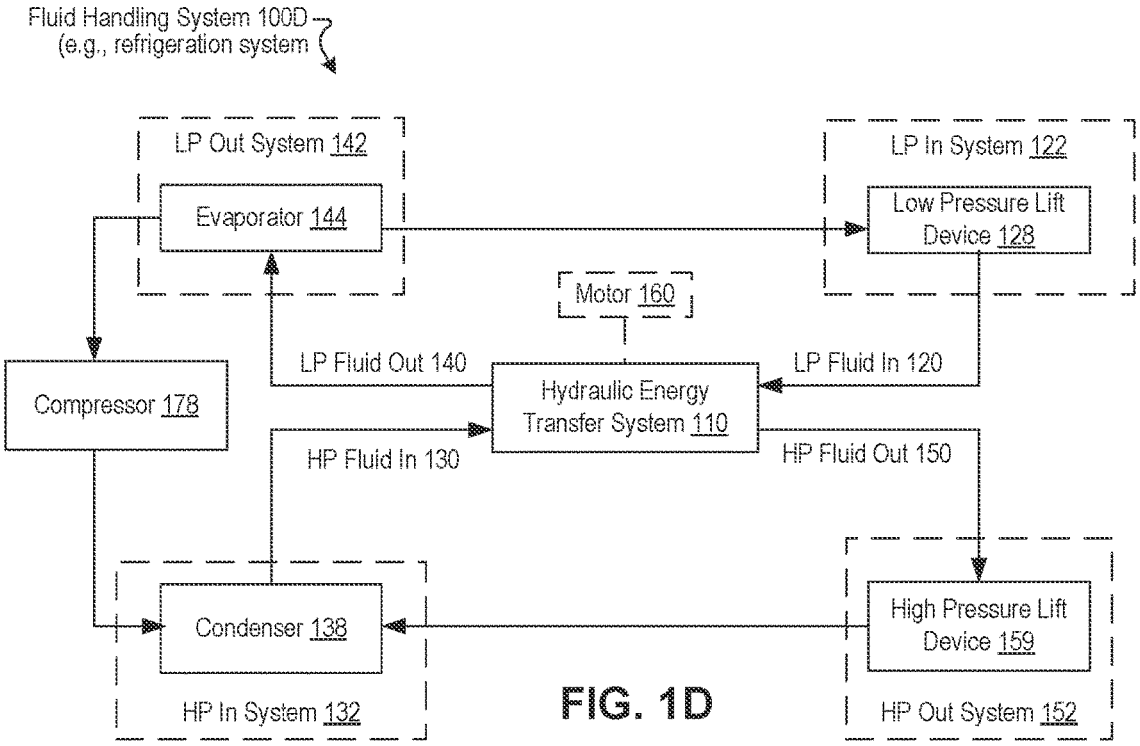

FIG. 1D illustrates a schematic diagram of a fluid handling system 100D including a hydraulic energy transfer system 110, according to certain embodiments. Fluid handling system 100D may be a refrigeration system. In some embodiments, fluid handling system 100D includes more components, less components, same routing, different routing, and/or the like than that shown in FIG. 1D.

Hydraulic energy transfer system 110 (e.g., PX) may receive LP fluid in 120 from LP in system 122 (e.g., low pressure lift device 128, low pressure fluid pump, etc.) and HP fluid in 130 from HP in system 132 (e.g., condenser 138). The hydraulic energy transfer system 110 (e.g., PX) may exchange pressure between the LP fluid in 120 and HP fluid in 130 to provide HP fluid out 150 to HP out system 152 (e.g., high pressure lift device 159) and to provide LP fluid out 140 to LP out system 142 (e.g., evaporator 144). The evaporator 144 may provide the fluid to compressor 178 and low pressure lift device 128. The condenser 138 may receive fluid from compressor 178 and high pressure lift device 159.

The fluid handling system 100D may be a closed system. LP fluid in 120, HP fluid in 130, LP fluid out 140, and HP fluid out 150 may all be a fluid (e.g., refrigerant) that is circulated in the closed system of fluid handling system 100D.

In some embodiments, the fluid of fluid handling system 100D may include solid particles. For example, the piping, equipment, connections (e.g., pipe welds, pipe soldering), etc. may introduce solid particles (e.g., solid particles from the welds) into the fluid in the fluid handling system 100D.

The solid particles in the fluid and/or the high pressure of the fluid may cause abrasion and/or erosion of components (e.g., rotor, end covers) of the PX of hydraulic energy transfer system 110.

FIGS. 2A-E are exploded perspective views a rotary PX 40 (e.g., rotary pressure exchanger, rotary liquid piston compressor (LPC)), according to certain embodiments.

PX 40 includes a rotor 46 configured to exchange pressure between a first fluid at a first pressure and a second fluid at a second pressure. The rotor 46 forms channels 70 (e.g., ducts) that are routed from a first distal end (e.g., opening 72) to a second distal end (e.g., opening 74). The PX 40 further includes an end cover 64 that forms a HPIN port (e.g., outlet aperture 76) configured to provide the first fluid at the first pressure into the channels 70. The end cover 64 forms a LPOUT port (e.g., outlet aperture 78) configured to receive the first fluid from the channels 70 at a third pressure. The PX 40 further includes an end cover 66 that forms a LPIN port (e.g., outlet aperture 80) configured to provide the second fluid at the second pressure into the channels 70 and forms a HPOUT port (e.g., outlet aperture 82) configured to receive the second fluid from the channels 70 at a fourth pressure.

In some embodiments, the PX 40 of FIGS. 2A-E has a HPIN port (e.g., outlet aperture 76) that is configured to provide the first fluid at the first pressure in a substantially axial direction into the channels 70 of the rotor 46 of the PX 40. In some embodiments, one or more sidewalls (e.g., radial sidewalls) of the end cover 64 that form the HPIN port (e.g., outlet aperture 76) or the LPOUT port are substantially planar (e.g., not curved). In some embodiments, the end cover 66 forms a first spot face proximate the LPIN port (e.g., outlet aperture 80) and a second spot face proximate the HPOUT port (e.g., outlet aperture 82).

PX 40 is configured to transfer pressure and/or work between a first fluid (e.g., proppant free fluid or supercritical carbon dioxide, HP fluid in 130) and a second fluid (e.g., frac fluid or superheated gaseous carbon dioxide, LP fluid in 120) with minimal mixing of the fluids. The rotary PX 40 may include a generally cylindrical body portion 42 that includes a sleeve 44 (e.g., rotor sleeve) and a rotor 46. The rotary PX 40 may also include two end caps 48 and 50 that include manifolds 52 and 54, respectively. Manifold 52 includes respective inlet port 56 and outlet port 58, while manifold 54 includes respective inlet port 60 and outlet port 62. In operation, these inlet ports 56, 60 enable the first and second fluids to enter the rotary PX 40 to exchange pressure, while the outlet ports 58, 62 enable the first and second fluids to then exit the rotary PX 40. In operation, the inlet port 56 may receive a high-pressure first fluid (e.g., HP fluid in 130), and after exchanging pressure, the outlet port 58 may be used to route a low-pressure first fluid (e.g., LP fluid out 140) out of the rotary PX 40. Similarly, the inlet port 60 may receive a low-pressure second fluid (e.g., LP fluid in 120) and the outlet port 62 may be used to route a high-pressure second fluid (e.g., HP fluid out 150) out of the rotary PX 40. The end caps 48 and 50 include respective end covers 64 and 66 (e.g., end plates) disposed within respective manifolds 52 and 54 that enable fluid sealing contact with the rotor 46.

As noted above, one or more components of the PX 40, such as the rotor 46, the end cover 64, and/or the end cover 66, may be constructed from a wear-resistant material (e.g., carbide, cemented carbide, silicon carbide, tungsten carbide, etc.) with a hardness greater than a predetermined threshold (e.g., a Vickers hardness number that is at least 1000, 1250, 1500, 1750, 2000, 2250, or more) For example, tungsten carbide may be more durable and may provide improved wear resistance to abrasive fluids as compared to other materials, such as alumina ceramics.

The rotor 46 may be cylindrical and disposed in the sleeve 44, which enables the rotor 46 to rotate about the axis 68. The rotor 46 may have a plurality of channels 70 (e.g., ducts, rotor ducts) extending substantially longitudinally through the rotor 46 with openings 72 and 74 (e.g., rotor ports) at each end arranged symmetrically about the longitudinal axis 68. The openings 72 and 74 of the rotor 46 are arranged for hydraulic communication with inlet and outlet apertures 76 and 78 (e.g., end cover inlet port and end cover outlet port) and 80 and 82 (e.g., end cover inlet port and end cover outlet port) in the end covers 64 and 66, in such a manner that during rotation the channels 70 are exposed to fluid at high-pressure and fluid at low-pressure. As illustrated, the inlet and outlet apertures 76 and 78 and 80 and 82 may be designed in the form of arcs or segments of a circle (e.g., C-shaped).

In some embodiments, a controller using sensor feedback (e.g., revolutions per minute measured through a tachometer or optical encoder or volume flow rate measured through flowmeter) may control the extent of mixing between the first and second fluids in the rotary PX 40, which may be used to improve the operability of the fluid handling system (e.g., fluid handling systems 100A-D of FIGS. 1A-D). For example, varying the volume flow rates of the first and second fluids entering the rotary PX 40 allows the plant operator (e.g., system operator) to control the amount of fluid mixing within the PX 40. In addition, varying the rotational speed of the rotor 46 also allows the operator to control mixing. Three characteristics of the rotary PX 40 that affect mixing are: (1) the aspect ratio of the rotor channels 70; (2) the duration of exposure between the first and second fluids; and (3) the creation of a fluid barrier (e.g., an interface) between the first and second fluids within the rotor channels 70. First, the rotor channels 70 (e.g., ducts) are generally long and narrow, which stabilizes the flow within the rotary PX 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 (e.g., rotor speed of approximately 1200 RPM) may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary PX 40. Moreover, in some embodiments, the rotary PX 40 may be designed to operate with internal pistons or other barriers, either complete or partial, that isolate the first and second fluids while enabling pressure transfer.

FIGS. 2B-2E are exploded views of an embodiment of the rotary PX 40 illustrating the sequence of positions of a single rotor channel 70 in the rotor 46 as the channel 70 rotates through a complete cycle. It is noted that FIGS. 2B-2E are simplifications of the rotary PX 40 showing one rotor channel 70, and the channel 70 is shown as having a circular cross-sectional shape. In other embodiments, the rotary PX 40 may include a plurality of channels 70 with the same or different cross-sectional shapes (e.g., circular, oval, square, rectangular, polygonal, etc.). Thus, FIGS. 2B-2E are simplifications for purposes of illustration, and other embodiments of the rotary PX 40 may have configurations different from that shown in FIGS. 2A-2E. As described in detail below, the rotary PX 40 facilitates pressure exchange between first and second fluids by enabling the first and second fluids to briefly contact each other within the rotor 46. In certain embodiments, this exchange happens at speeds that result in limited mixing of the first and second fluids. The speed of the pressure wave traveling through the rotor channel 70 (as soon as the channel is exposed to the aperture 76), the diffusion speeds of the fluids, and the rotational speed of rotor 46 dictate whether any mixing occurs and to what extent.

Figure 2A:
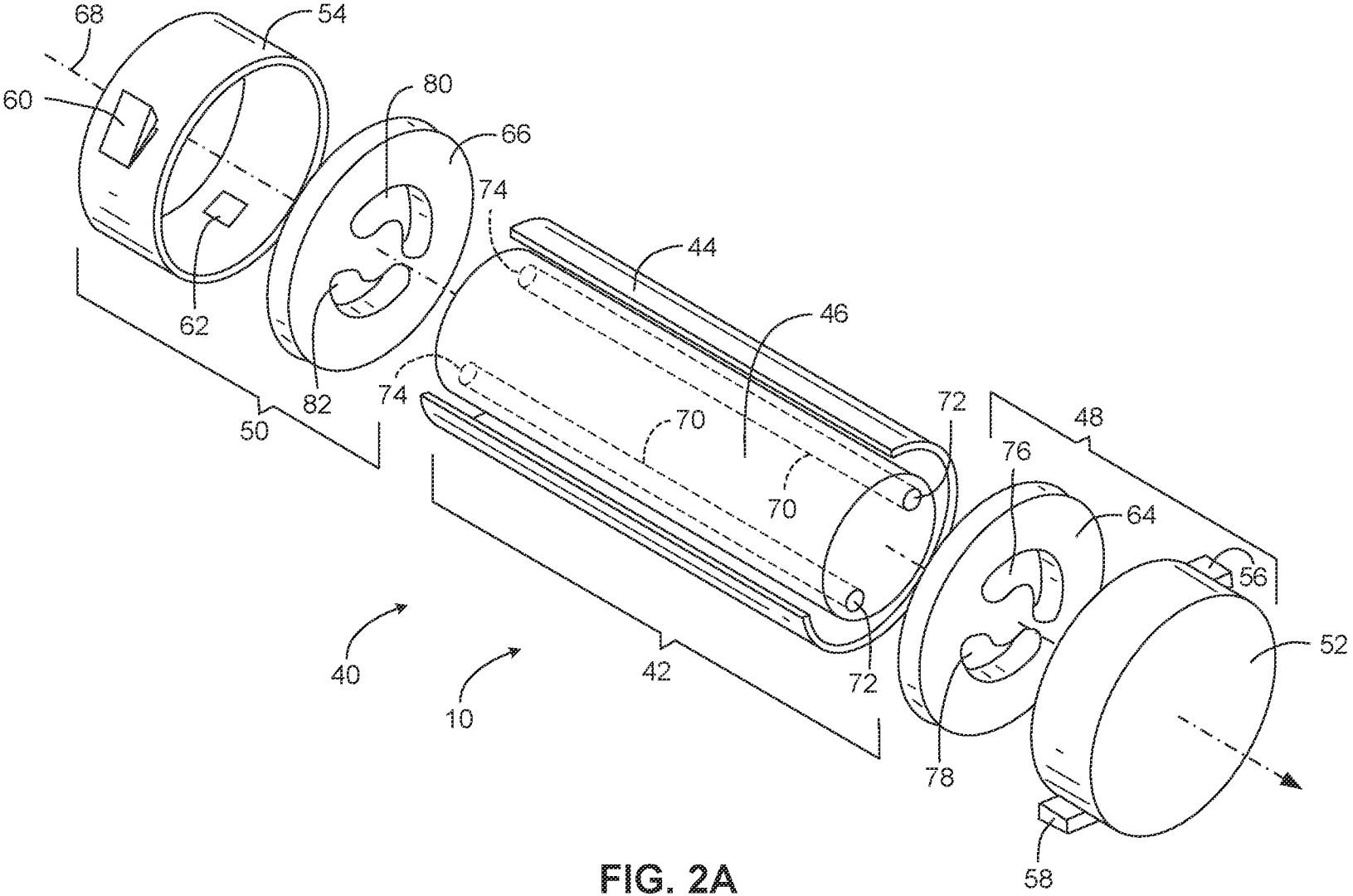
FIGS. 2A-E are exploded perspective views a pressure exchanger, according to certain embodiments.
Figure 2D:
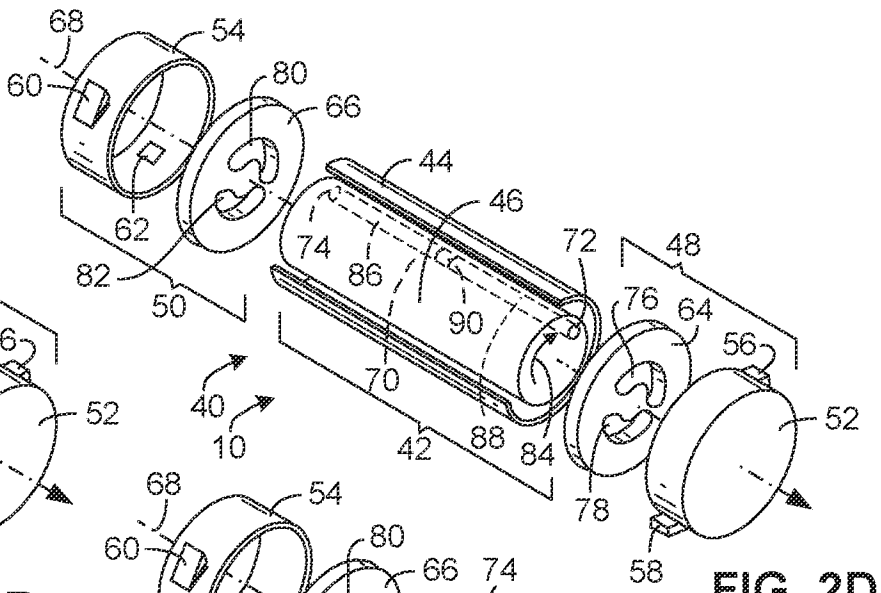
Figure 2E:
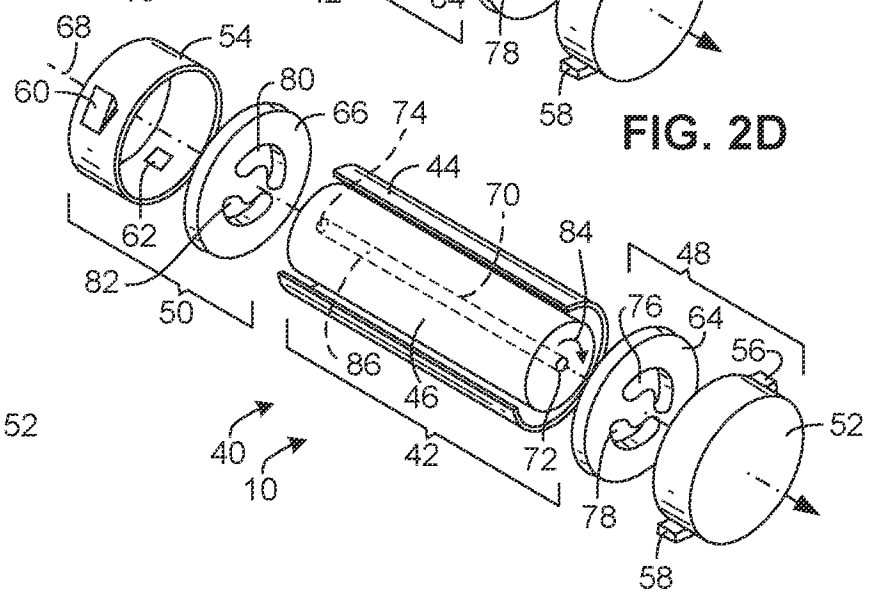
Figure 2B:
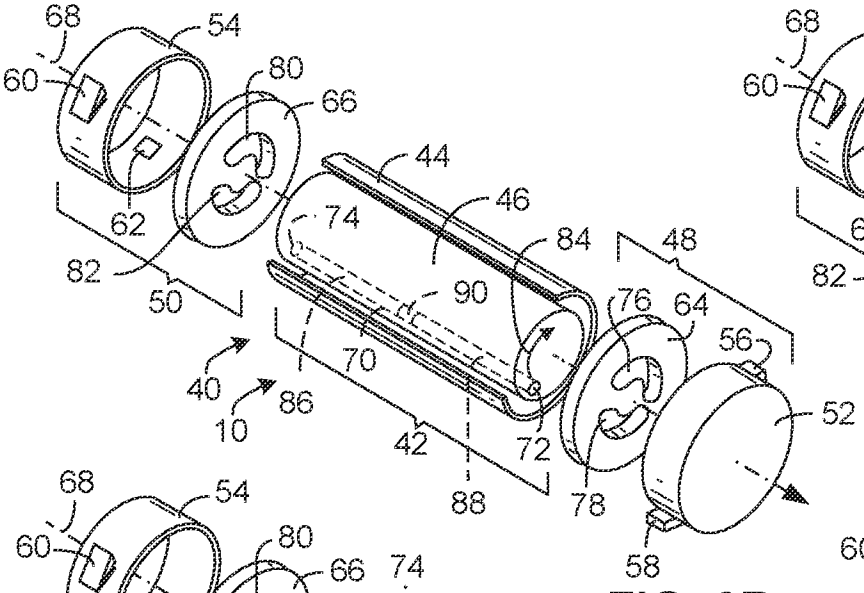

FIG. 2B is an exploded perspective view of an embodiment of a rotary PX 40 (e.g., rotary LPC), according to certain embodiments. In FIG. 2B, the channel opening 72 is in a first position. In the first position, the channel opening 72 is in fluid communication with the aperture 78 in end cover 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary PX 40. However, because of the short duration of contact, there is minimal mixing between the second fluid 86 and the first fluid 88.

Figure 2C:
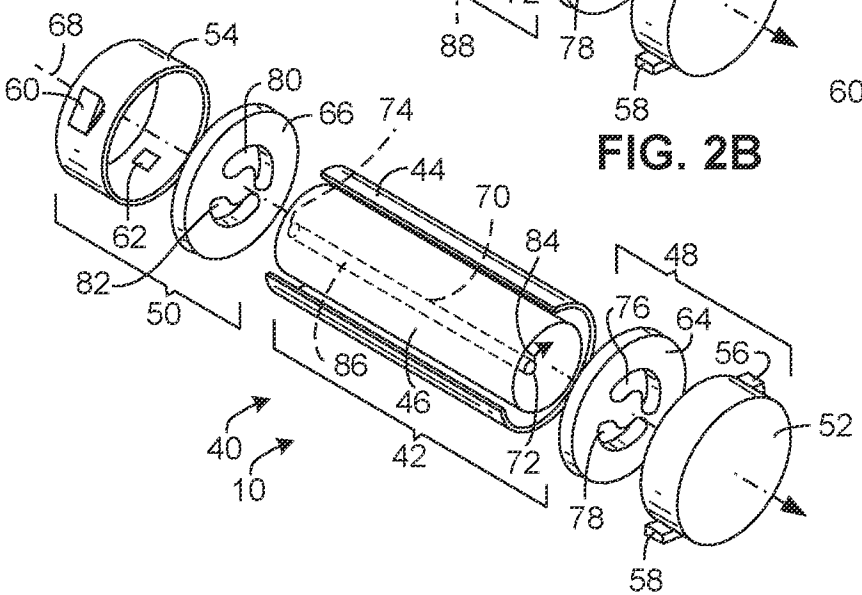

FIG. 2C is an exploded perspective view of an embodiment of a rotary PX 40 (e.g., rotary LPC), according to certain embodiments. In FIG. 2C, the channel 70 has rotated clockwise through an arc of approximately 90 degrees. In this position, the opening 74 (e.g., outlet) is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

FIG. 2D is an exploded perspective view of an embodiment of a rotary PX 40 (e.g., rotary LPC), according to certain embodiments. In FIG. 2D, the channel 70 has rotated through approximately 60 degrees of arc from the position shown in FIG. 2B. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86, driving the second fluid 86 out of the rotor channel 70 and through the aperture 80.

FIG. 2E is an exploded perspective view of an embodiment of a rotary PX 40 (e.g., rotary LPC), according to certain embodiments. In FIG. 2E, the channel 70 has rotated through approximately 270 degrees of arc from the position shown in FIG. 2B. In this position, the opening 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 3A:
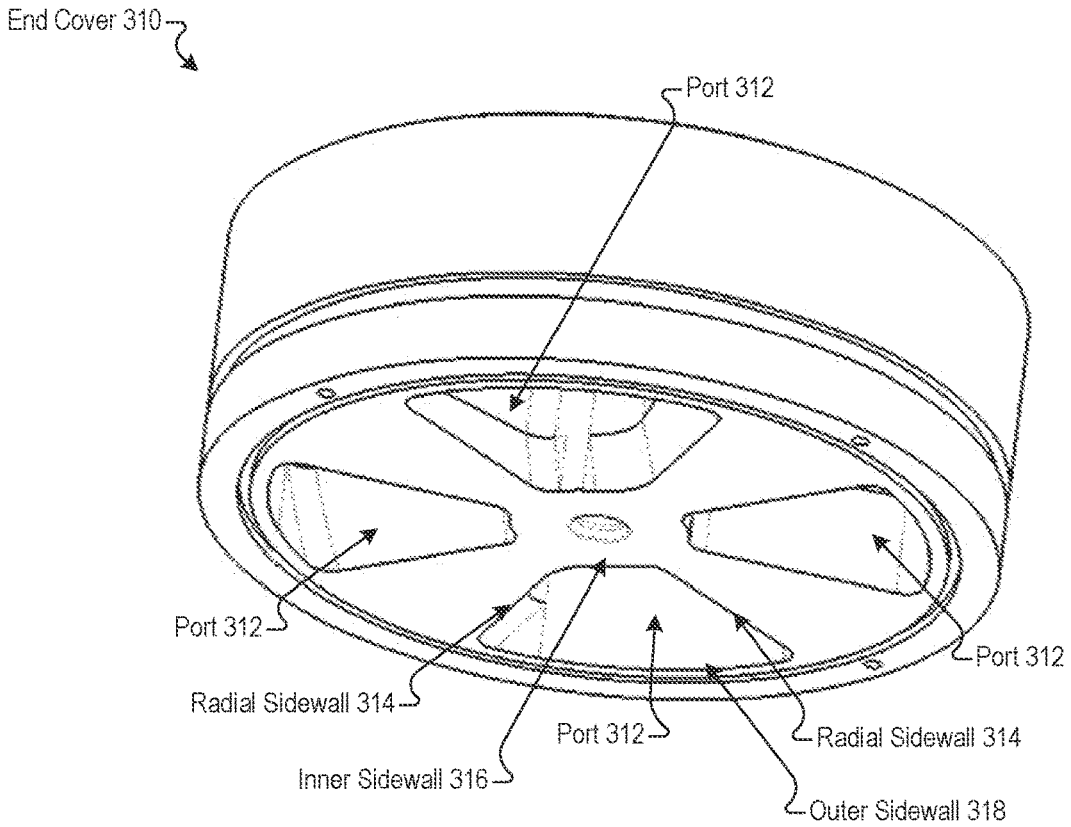
FIGS. 3A-P illustrate components of pressure exchangers, according to certain embodiments.
Figure 3B:
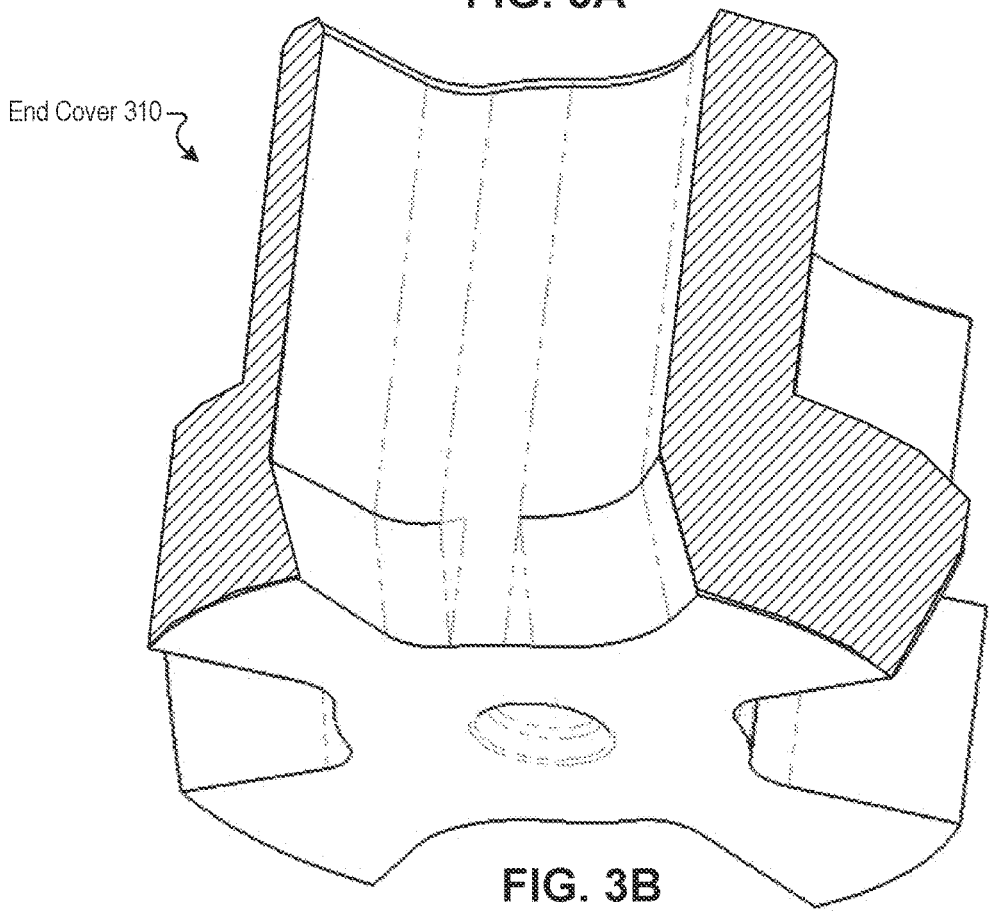
Figure 3C:
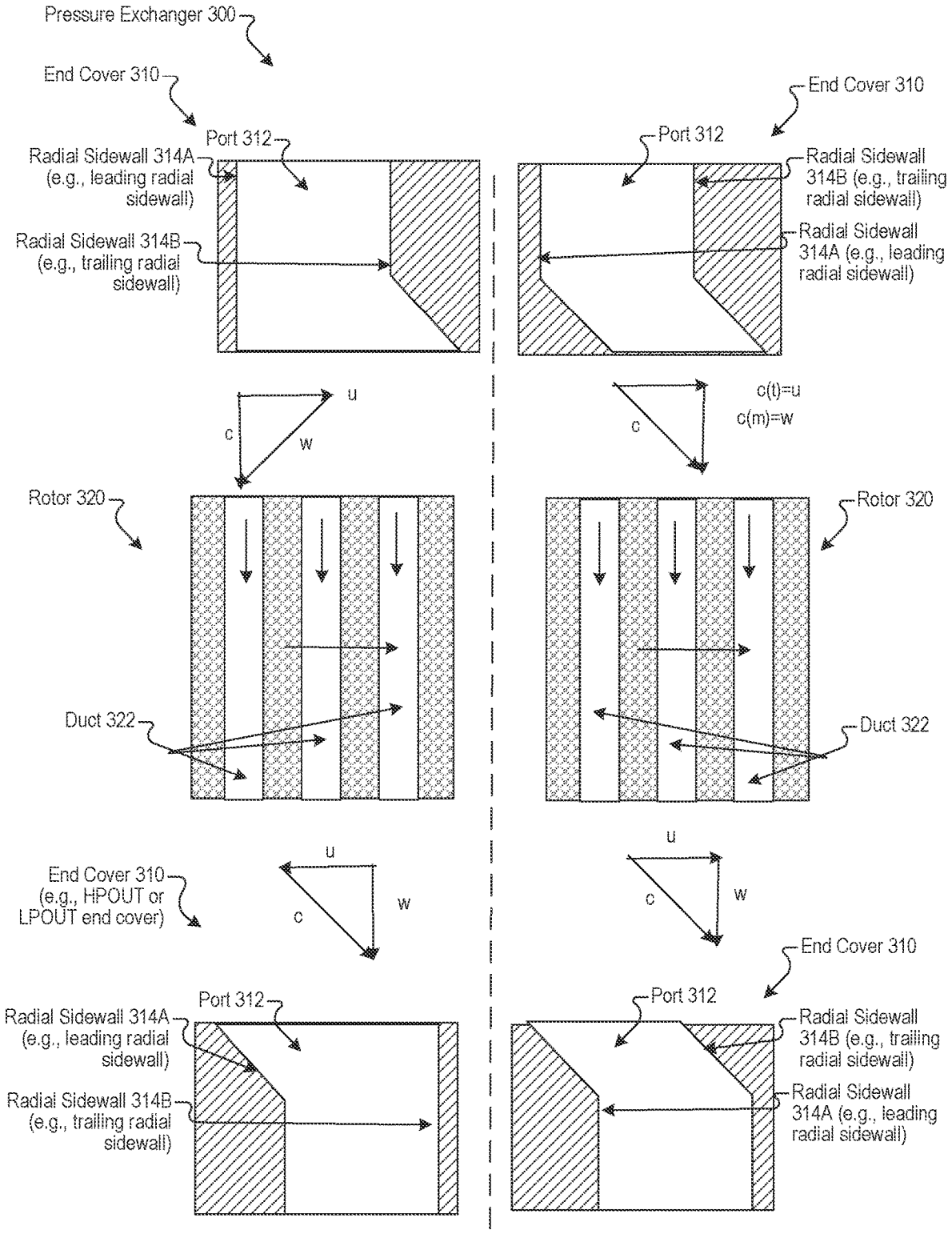
Figure 3D:
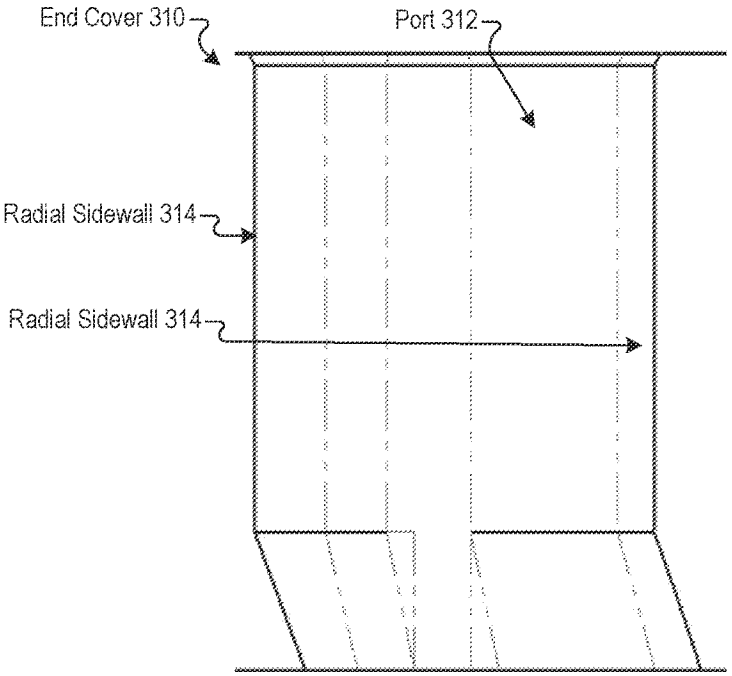
Figure 3E:
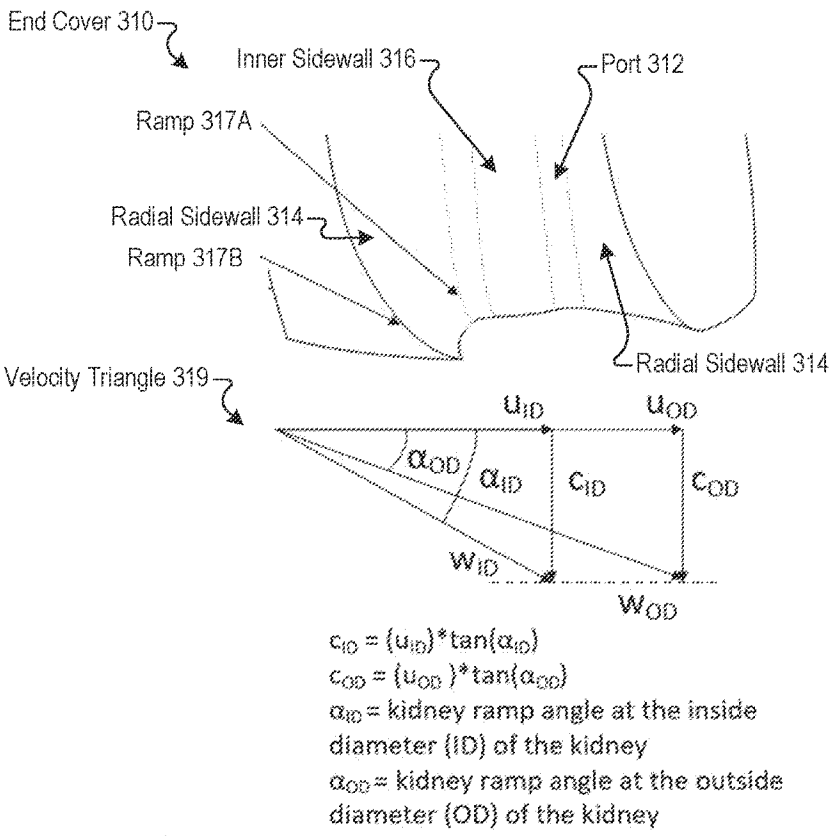
Figure 3F:
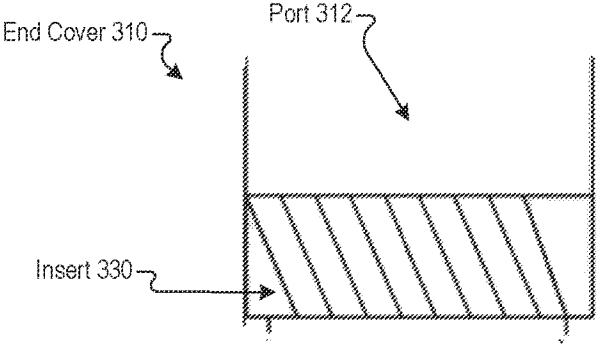
Figure 3G:
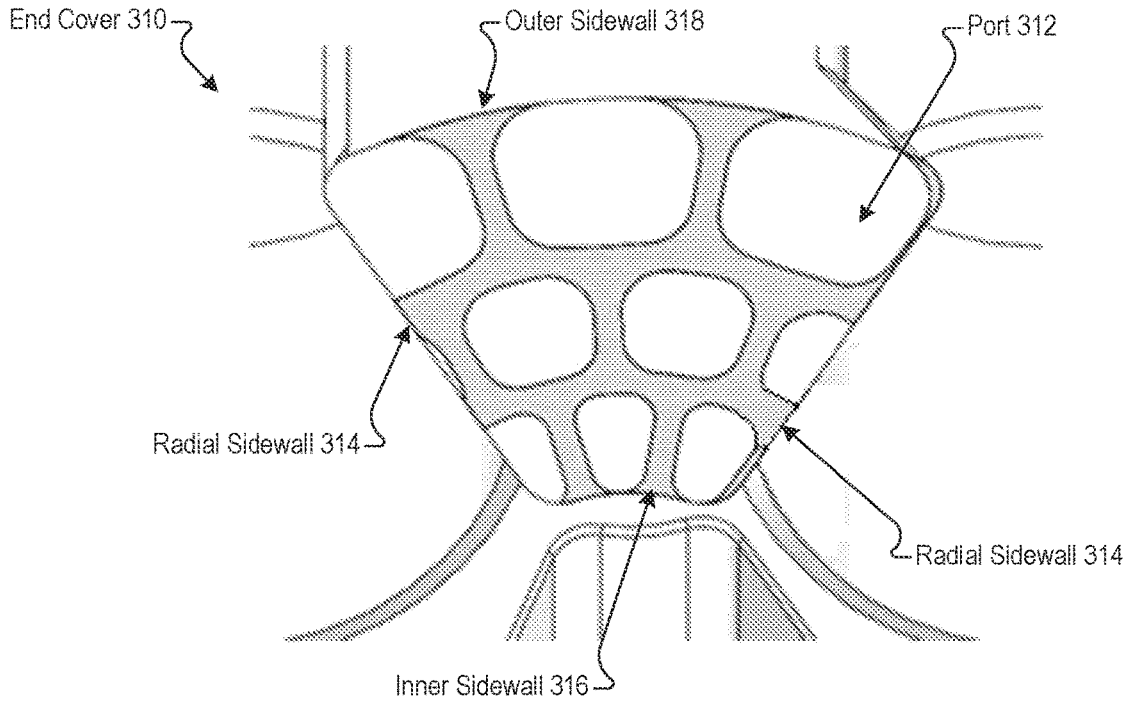
Figure 3H:
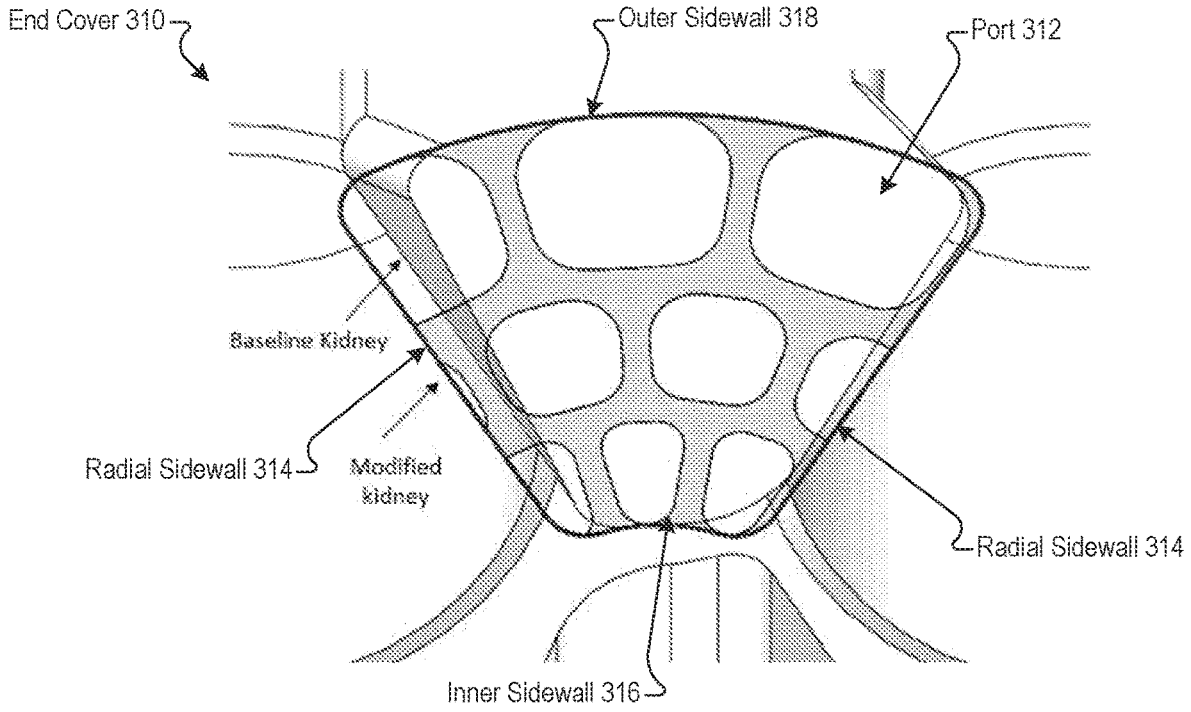
Figure 3I:
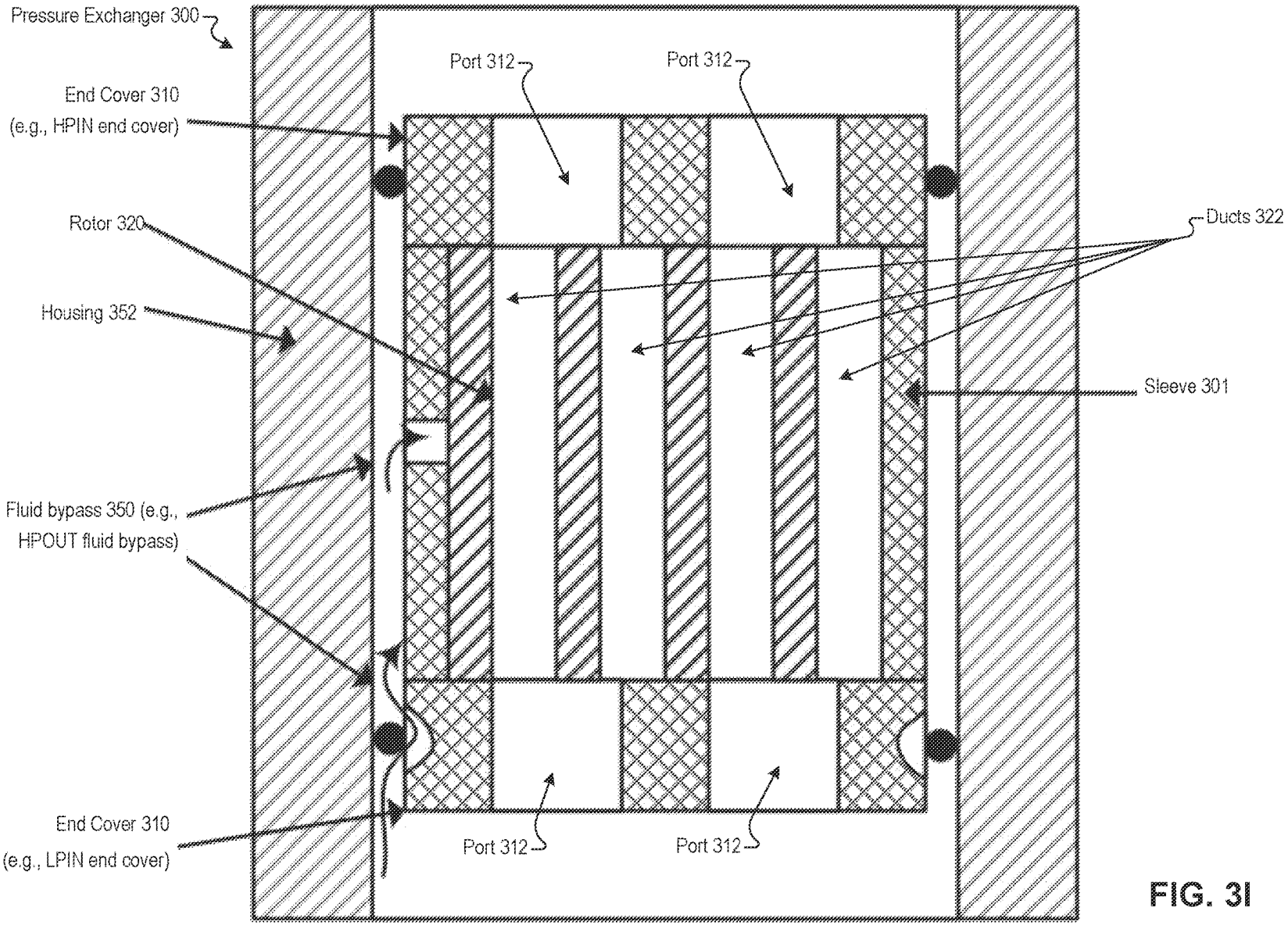
Figure 3J:
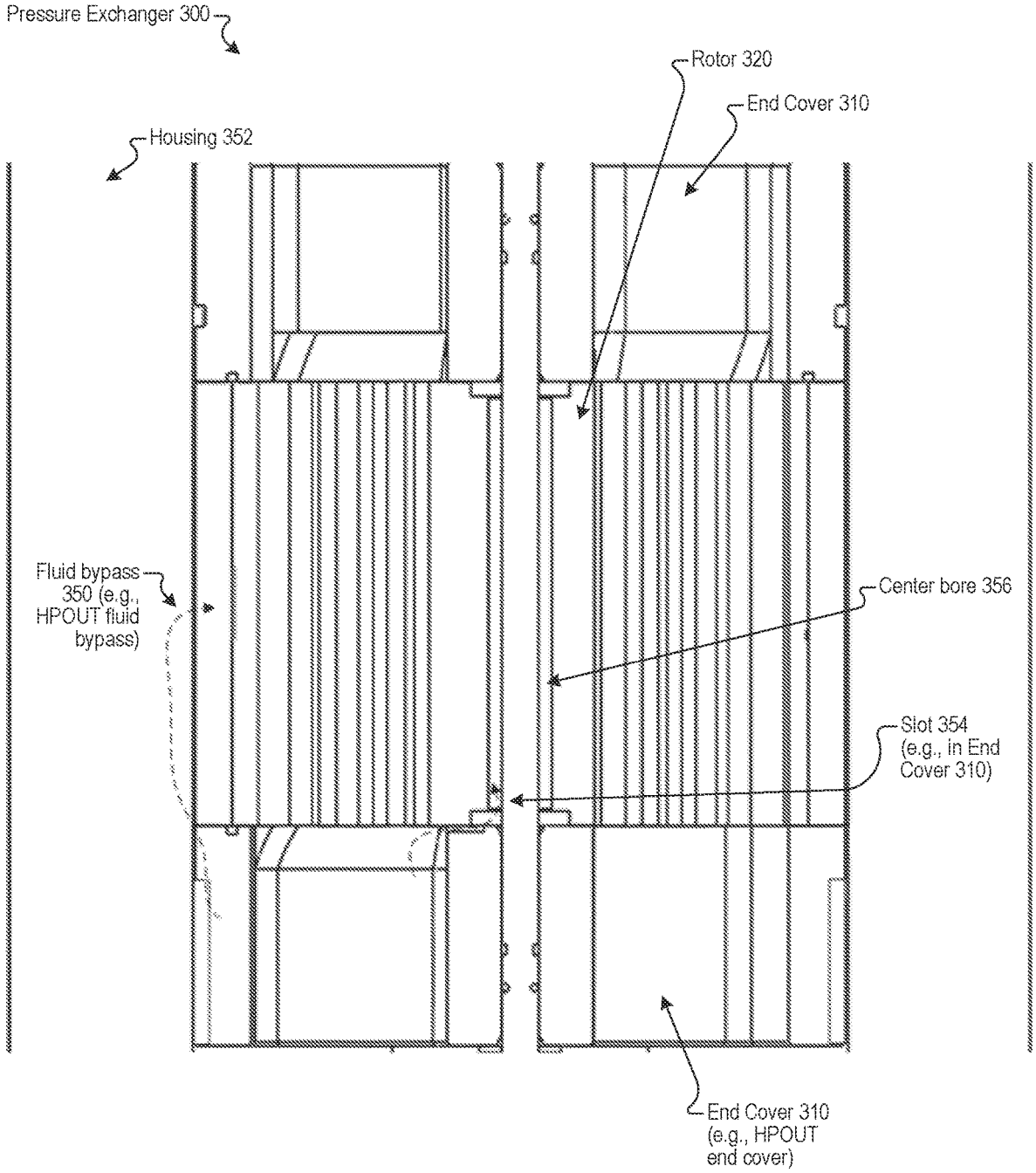
Figure 3K:
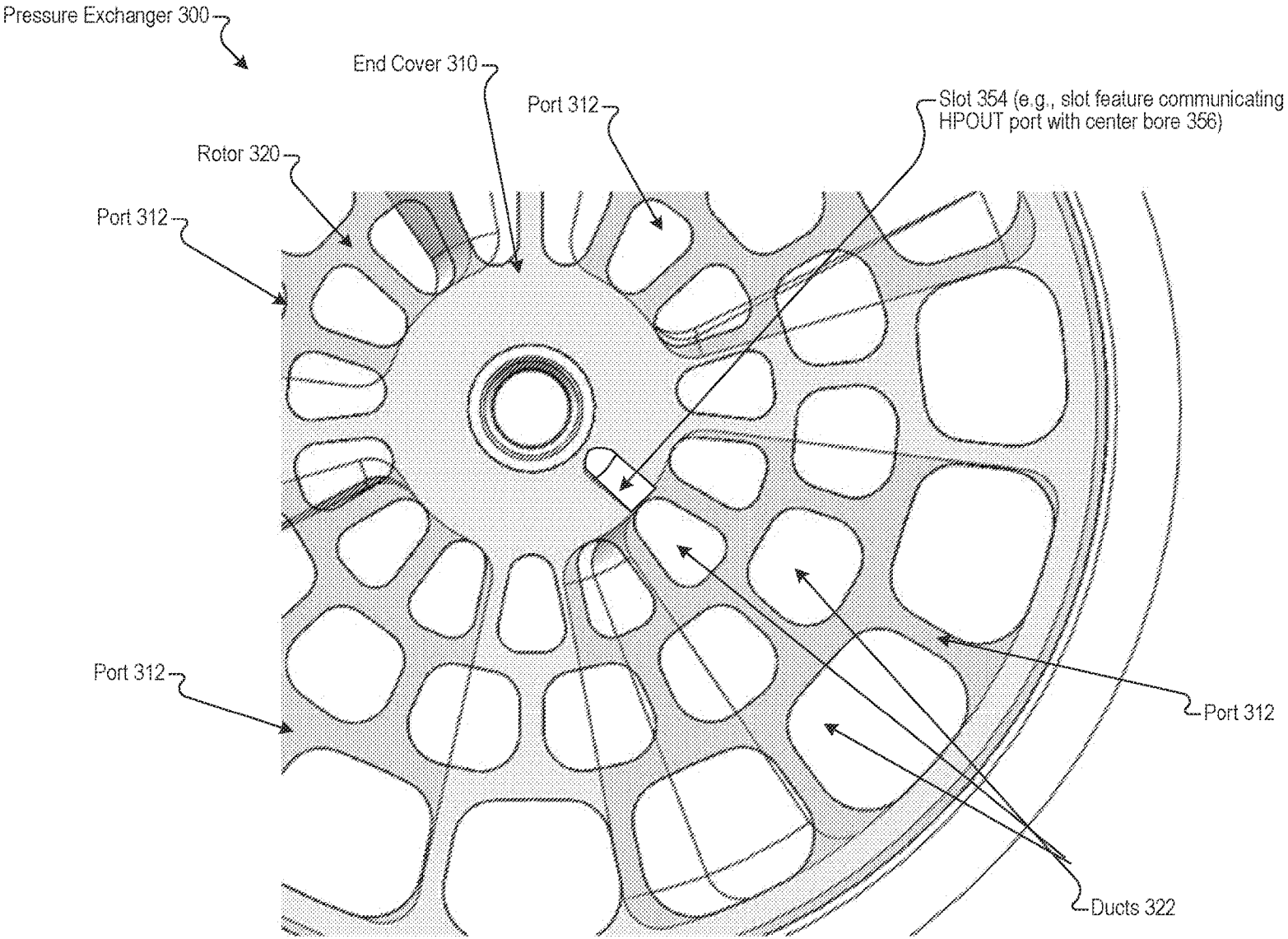
Figure 3M:
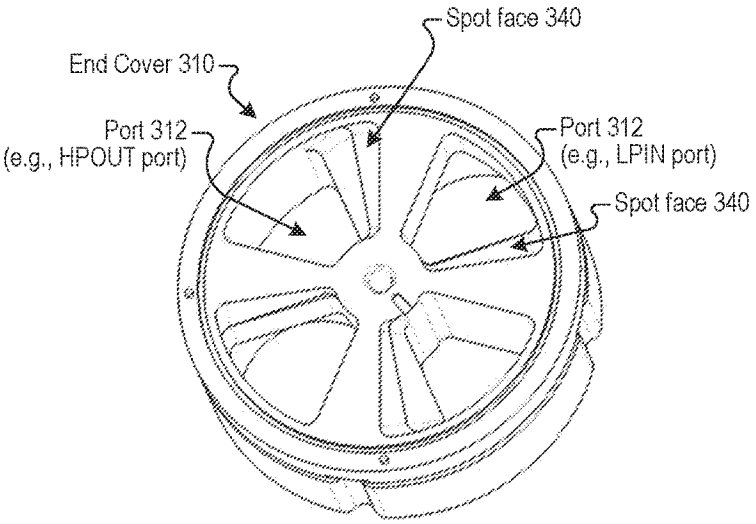
Figure 3O:
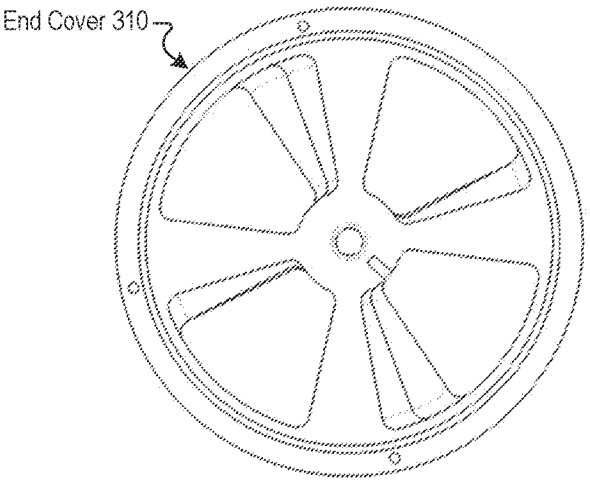
Figure 3L:
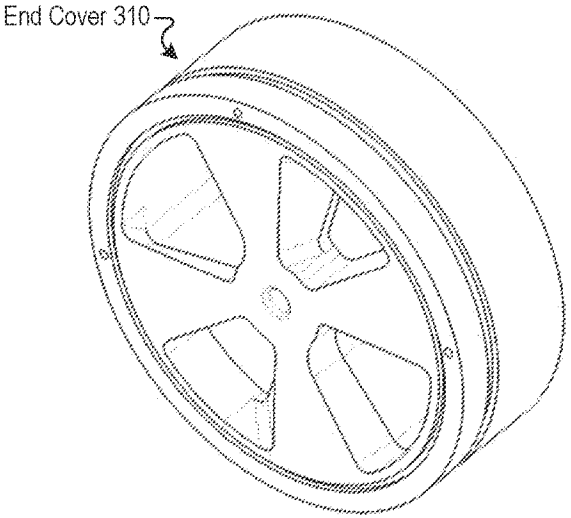
Figure 3N:
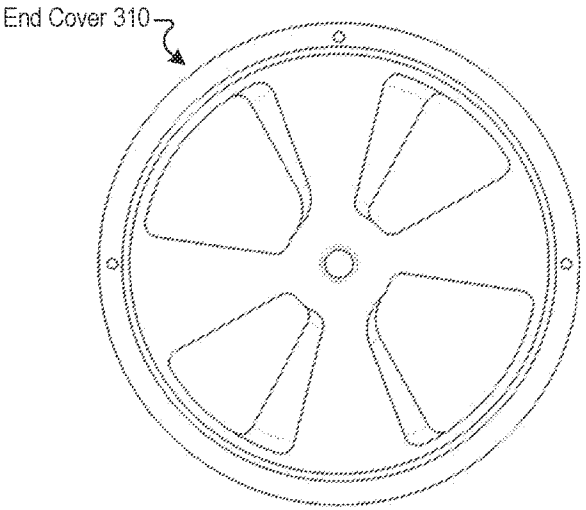
Figure 3P:
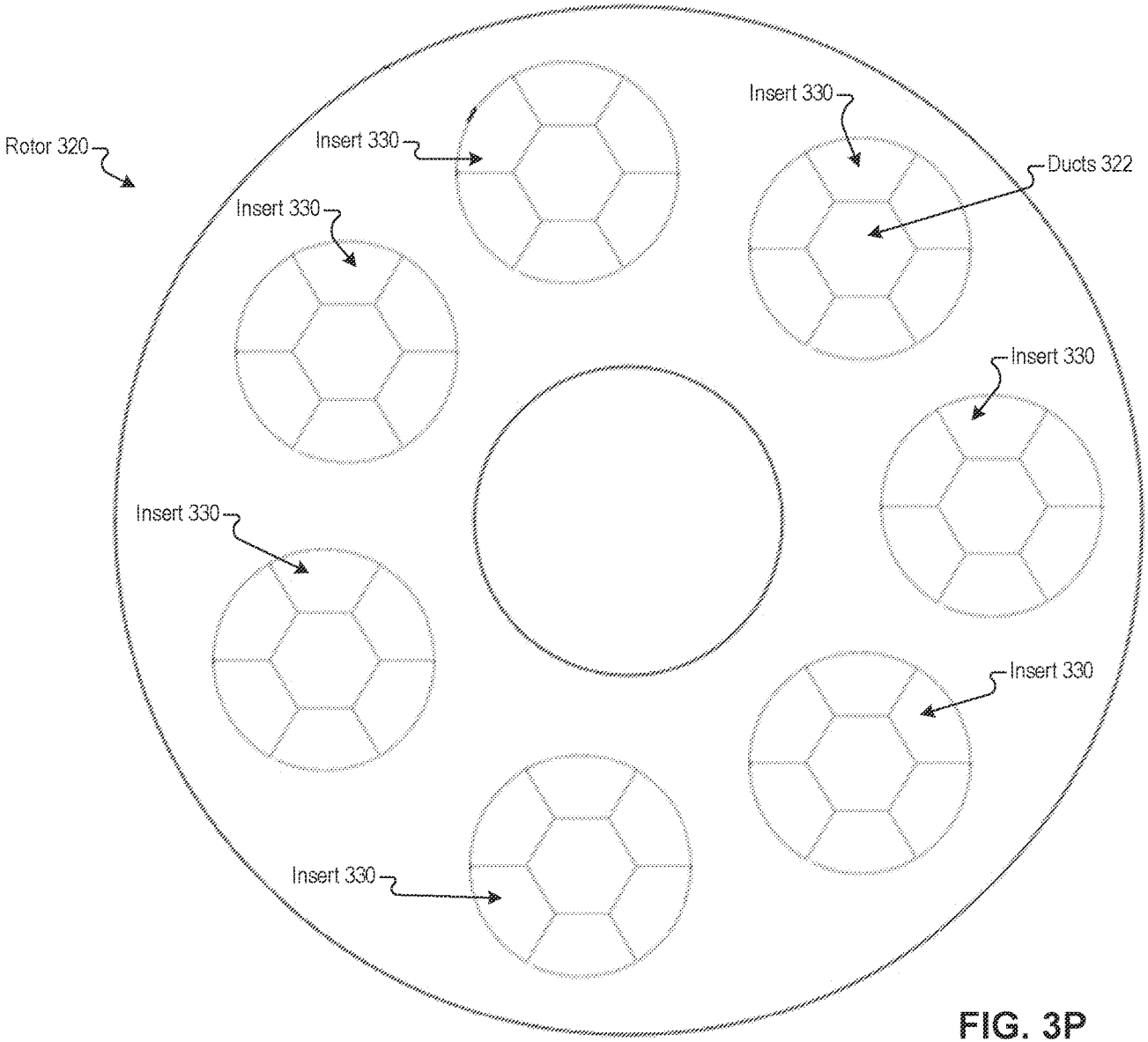

FIGS. 3A-P illustrate components of pressure exchangers 300 (e.g., PXs 40 of FIGS. 2A-E), according to certain embodiments. Features in FIGS. 3A-P that have similar names and/or reference numbers as features in one or more of FIGS. 1A-2E may include the same or similar structure, material, functionality, and/or the like as features in one or more of FIGS. 1A-2E. In some embodiments, one or more features of PX 300 of FIGS. 3A-P reduce mixing of fluids in the PX 300.

FIG. 3A illustrates a perspective view of an end cover 310 (e.g., end cover 64 and/or 66 of one or more of FIGS. 2A-E). FIG. 3B illustrates a perspective cut-away view of an end cover 310 (e.g., of FIG. 3A, end cover 64 and/or end cover 66 of one or more of FIGS. 2A-E). FIG. 3C illustrates a cross-sectional view of components of the pressure exchanger 300 (e.g., of FIGS. 3A and/or 3B, end cover 64 and/or 66 of one or more of FIGS. 2A-E, rotor 46 of one or more of FIGS. 2A-E).

In some embodiments, a PX 300 includes a rotor 320 and end covers 310. The rotor 320 is configured to rotate to exchange pressure between a first fluid at a first pressure and a second fluid at a second pressure. The rotor 320 forms ducts 322 (e.g., channel 70 of FIGS. 2A-E) that are routed from a first distal end of the rotor 320 to a second distal end of the rotor 320.

The PX 300 may include first and second end covers 310. The first end cover 310 is disposed at the first distal end of the rotor 320 and the second end cover 310 is disposed at the second distal end of the rotor 320.

End cover 310 is disposed at a distal end of the rotor 320. End cover 310 forms ports 312 (e.g., apertures 76 and 78 of FIGS. 2A-E, apertures 80 and 82 of FIGS. 2A-E, inlet, outlet, HPIN port, HPOUT port, LP IN port, LPOUT port)

In some embodiments, end cover 310 (e.g., disposed at a first distal end of the rotor 320) forms an HPIN port configured to provide the first fluid at the first pressure in a substantially axial direction into the ducts 322 and an LPOUT port configured to receive the first fluid from the ducts 322 at a third pressure that is lower than the first pressure.

In some embodiments, end cover 310 (e.g., disposed at a second distal end of the rotor 320) forms an LPIN port configured to provide the second fluid at the second pressure into the ducts 322 and forms an HPOUT port configured to receive the second fluid from the ducts 322 at a fourth pressure that is higher than the second pressure.

In some embodiments, PX 300 may include two ramps to reduced rotor incidence losses and to prevent skewing of the interface.

In some embodiments, and end cover insert 330 (e.g., made of polycarbonate, fiber reinforced polytetrafluoroethylene (PTFE) and/or polyetheretherketone (PEEK)) to guide the flow.

In some embodiments, end cover 310 has 3D ramps.

In some embodiments, end cover 310 has an HPIN kidney closure earlier than HPOUT by at least 2 degrees to avoid acceleration of flow as duct closes.

In some embodiments, end cover 310 has a fillet (e.g., large fillet) at HPIN kidney exit diameter corner (e.g., to reduce mixing through inner row of ducts).

In some embodiments, PX 300 has HPIN kidney opening later than HPOUT to help move interface away from HPOUT and to reduce mixing at HPOUT.

In some embodiments, spot faces are located at HPOUT open (and not on HPIN open) to reduce mixing at HPOUT and to avoid disturbing the interface which is close to HPIN open.

In some embodiments, HPOUT fluid is used as bearing fluid and center bore fluid (e.g., to reduce mixing of HPIN to HPOUT through leakage in axial gaps).

In some embodiments, length to depth (L/D) ratio and roundness of ducts 322 are maximized.

In some embodiments, honeycomb flow straighteners are used as inserts in the ducts 322 to reduce mixing.

In some embodiments, an end cover 310 includes radial sidewalls 314 (e.g., leading radial sidewall 314A, trailing radial sidewall 314B), an inner sidewall 316, and an outer sidewall 318 that form a port 312 (e.g., HPIN port, HPOUT port, LPIN port, LPOUT). Leading radial sidewall 314A is the first radial sidewall that a duct 322 sees as it rotates. The trailing radial sidewall 314B is the sidewall of the same port that the rotor duct 322 sees after the leading radial side wall. In some embodiments, ports 312 have similar sizes. In some embodiments, the radial sidewalls 314 of the HPIN port are at least two degrees (e.g., four degrees, six degrees, eight degrees, ten degrees, etc.) closer to each other that radial sidewalls 314 of the HPOUT port are to each other (e.g., see FIGS. 3G-H) (e.g., are offset relative to each other). For example, FIG. 3G may be an HPOUT port and FIG. 3H may be an HPIN port.

In some embodiments, at least one of the radial sidewalls 314 (e.g., trailing radial sidewall) that form the HPIN port is configured to close relative to a duct 322 formed by the rotor 320 at least two degrees (e.g., four degrees, six degrees, eight degrees, ten degrees, etc.) prior to at least one of the second radial sidewalls (e.g., trailing radial sidewall) that form the HPOUT port closes relative to the duct 322 (e.g., to reduce mixing of corresponding fluid between HPIN and HPOUT, reduce mixing of HPIN into HPOUT) (e.g., are offset relative to each other).

In some embodiments, at least one of the radial sidewalls 314 (e.g., trailing radial sidewall) that form the LPIN port is configured to close relative to a duct 322 formed by the rotor 320 at least two degrees (e.g., four degrees, six degrees, eight degrees, ten degrees, etc.) prior to at least one of the second radial sidewalls (e.g., trailing radial sidewall) that form the LPOUT port closes relative to the duct 322 (e.g., to reduce mixing of corresponding fluid between LPIN and LPOUT, reduce mixing of LPIN into LPOUT) (e.g., are offset relative to each other).

In some embodiments, one or more radial sidewalls of the LPOUT port are biased to reduce mixing at the LPOUT port.

In some embodiments, each of the radial sidewalls 314 that form the HPIN port have a substantially straight edge that substantially matches a corresponding substantially straight edge of a duct 322 formed by the rotor 320 (e.g., to maximize the time of duct 322 exposure to the port to improve efficiency).

In some embodiments, a first end cover 310 forms a first port and a second port, where a first substantially straight radial edge of the first port and a second substantially straight radial edge of the second port substantially match corresponding substantially straight edges of the ducts 322 of the rotor 320. In some embodiments, a second end cover 310 forms a third port and a fourth port, where a third substantially straight radial edge of the third port and a fourth substantially straight radial edge of the fourth port substantially match the corresponding substantially straight edges of the ducts 322 of the rotor 320.

In some embodiments, at least one of the radial sidewalls 314 (e.g., leading radial sidewall) that form the HPIN port is configured to open relative to a duct 322 formed by the rotor 320 at least two degrees (e.g., four degrees, six degrees, eight degrees, ten degrees, etc.) later than at least one of the second radial sidewalls (e.g., leading radial sidewall) that form the HPOUT port opens relative to the duct 322 (e.g., are offset relative to each other).

In some embodiments, an end cover 310 (e.g., that forms HPIN port) forms a fillet (or filet) (e.g., concave strip of material roughly triangular in cross section that rounds off an interior angle between two surfaces) between at least one of the radial sidewalls 314 and an inner sidewall 316. In some embodiments, the end cover 310 that forms the HPOUT port may form the HPOUT port without a fillet between the radial sidewalls 314 and the inner sidewall 316. The fillet of the end cover 310 (e.g., that forms HPIN port) is configured to close the HPIN port relative to a duct 322 of the rotor 320 prior to the HPOUT port of the end cover that forms HPOUT port closes relative to the duct 322.

The fillet may be located at HPIN port exit inner diameter corner. The rotor 320 may form multiple circular rows of ducts 322 with outer rows being approximately trapezoidal in shape and the inner most row being triangular in shape. Due to the reduction in roundness from outer ducts to inner ducts, the inner most row of triangular shaped ducts may contribute more to mixing at HPOUT (per unit flow area) than ducts in the outer rows. By increasing the filet radius at the inner diameter exit corner of the HPOUT port, mixing contribution from inner ducts may be reduced. A fillet at HPIN port bottom corner results in reduction of fluid (e.g., brine concentration, the fluid with which pressure is being exchanged) exiting out of the HPOUT row from the inner row of ducts 322.

In some embodiments, the radial sidewalls 314 of the end cover 310 (e.g., that forms LPIN port and HPOUT port) each form a ramp (e.g., sloped sidewall, sidewall that is not perpendicular to the face of the end cover) (e.g., see FIGS. 3A-E) and the radial sidewalls 314 of the other end cover forms HPIN port (e.g., and LPOUT port) without forming ramps.

In some embodiments, the radial sidewalls 314 of the end cover 310 (e.g., that forms LPIN port and HPOUT port) each form a ramp (e.g., sloped sidewall, sidewall that is not perpendicular to the face of the end cover) (e.g., see FIGS. 3A-E) and the radial sidewalls 314 of the other end cover forms HPIN port (e.g., and LPOUT port) each form a ramp.

The first radial sidewalls include a leading sidewall and a trailing sidewall on the HPIN port that each have a corresponding ramp angle varying from about 30 degrees to about 70 degrees measured with respect to a face of the rotor 320.

In some embodiments, leading radial sidewall and trailing radial sidewall on the LPIN port form a ramp in direction of rotation. The ramp has a ramp angle varying from about 30 degrees to about 70 degrees measured with respect to a face of the rotor 320.

In some embodiments, the radial sidewalls 314 of the end cover 310 (e.g., that forms LPIN port and HPOUT port) form non-planar three-dimensional ramps (e.g., see ramps 317A-B of FIG. 3E). In some embodiments, the first radial sidewalls form non-planar three-dimensional ramps defined by at least two helix at an innermost radius and outermost radius of the port. In some embodiments, a corresponding ramp of the non-planar three-dimensional ramps is defined by a spiral that has a pitch that is proportional to a radius at which the corresponding ramp is located to reduce incidence (e.g., to reduce incidence and to cause absolute velocity (c) to be similar at any radius of the port).

The ramps 317 may be associated with velocity triangle 319. Velocity triangle 319 may include the following:

$c_{ID}=(u_{ID})*\tan(\alpha_{ID})$ $c_{OD}=(u_{OD})*\tan(\alpha_{OD})$ $\alpha_{ID}$=kidney ramp angle at the inside diameter (ID) of the kidney (port 312 of end cover 310)

$\alpha_{OD}$=kidney ramp angle at the outside diameter (OD) of the kidney (port 312 of end cover 310)

$u_{ID}$=tangential velocity at inner diameter of port $u_{OD}$=tangential velocity at outer diameter of port $c_{ID}$=absolute velocity at inner diameter of port $c_{OD}$=absolute velocity at outer diameter of port Flow exiting the rotor 320 of a PX 300 may have a combination of axial and tangential components of flow velocity. The axial component is a function of flow rate and the tangential component is a function of rotor speed and radial position of the duct 322. In some embodiments, the outlet kidneys (e.g., port 312 of end cover 310) are shaped to allow for smooth transition of this three-dimensional (3D) velocity field from the rotor 320 to a one-dimensional (1D) velocity field along the stator conduits (e.g., ports 312 of end cover 310). Otherwise, shock losses may result due to flow separation and eddy formation in the outlet kidneys (e.g., ports 312 of end cover 310). The exit ramps can have a single ramp angle based on the design flow rate, target RPM, a median radial position of the duct 322, and/or the like. The outlet kidneys (e.g., ports 312 of end cover 310) can also have dual ramps at the beginning and end of the outlet kidneys with similar considerations. In some embodiments, a 3D-shaped outlet kidney (e.g., port 312 of end cover 310) may have a ramp angle that varies continually with the radial position. To overcome manufacturing difficulties of the 3D ramps, an injection molded plastic insert with a particular shape can be embedded into the outlet kidneys (e.g., port 312 of end cover 310).

In some embodiments, the end cover 310 includes an insert 330 disposed in the HPIN port, where the insert is configured to guide flow and to reduce flow incidence at the rotor 320 (e.g., see FIG. 3F).

In some embodiments, the end cover 310 forms a first spot face 340 proximate the HPIN port (e.g., without forming a spot face at the HPIN port to reduce mixing of corresponding fluid between the HPIN port and the HPOUT port) and forms a second spot face 340 proximate the LPOUT port (e.g., see FIGS. 3L-O). In some embodiments, the first end cover 310 forms a second spot face proximate the LPOUT port without forming a spot face at the LPIN port to reduce mixing of corresponding fluid between the LPIN port and the LPOUT port.

In some embodiments, the pressure exchanger 300 (e.g., PX 40) is configured to use the second fluid provided via the LPIN port and/or HPOUT port as bearing fluid and/or centerbore fluid (e.g., see FIGS. 3I-K).

FIG. 3P illustrates PX 300, according to certain embodiments. Rotor 320 may include inserts 330 disposed in ducts 322. The inserts may provide a length to diameter ratio of about 5 to about 10. The inserts may be honeycomb-shaped inserts. The inserts may be honeycomb-shaped flow straighteners that are press-fit or shrunk-fit into the ducts. The inserts 330 may maximize the length to diameter (L/D) ratio and the roundness of ducts 322. The inserts 330 may be honeycomb flow straighteners in the ducts 322 to reduce mixing of fluids.

Turbulence of unsteady fluid flow in the ducts 322 may cause (e.g., may be a major source of) intra-duct mixing. This results in skewing & stretching of the "mixing zone" between the two fluids in the duct 322. In some embodiments, to mitigate this, the aspect ratio of duct geometry (e.g., length to diameter—L/D) is to be increased by inserting inserts 330 (e.g., honeycomb flow straighteners) into the ducts 322. The flow straighteners can be press-fit or shrunk-fit into the ducts 322 or attached to the duct walls mechanically or adhesively (e.g., gluing). The insert 330 (e.g., flow straightener) can have shapes other than honeycomb and the insert 330 may divide a duct of a certain L/D ratio into multiple ducts of larger L/D ratio. Breaking a duct into multiple small ducts also reduces cavitation and noise by temporally spreading out pressurization and depressurization events at kidney openings (e.g., openings of ports 312 of end covers 310).

In some embodiments, pressure exchanger 300 is used to minimize mixing of two fluids inside the pressure exchanger 300. In the pressure exchanger 300, liquid-to-liquid pressure exchange may take place via an oscillating "liquid plug" in the rotor ducts. The "liquid plug" may not be impenetrable and conventionally a small amount of mixing may occur between the two fluids exchanging their pressure energy. Mixing may be dependent on one or more factors, such as travel distance of the "liquid plug" (e.g., portion of the duct 322 of the rotor 320 traverses), turbulence, diffusion, jetting, entry and/or exit losses of the rotor 320, etc. Efficiency of the pressure exchanger 300 may be directly proportional to the travel distance of the "liquid plug." Mixing of a first fluid and a second fluid in the pressure exchanger 300 may be inversely proposal to the travel distance (and to the efficiency in the pressure exchanger 300). In some examples, less travel distance results in less mixing and lower efficiency. In some examples, more travel distance results in more mixing and higher efficiency (e.g., features that attempt to increase efficiency by increasing travel distance conventionally also increase mixing within the pressure exchanger). In some applications (e.g., a SWRO plant), efficiency of a pressure exchanger 300 is to be maximized and mixing within the pressure exchanger 300 is to be minimized to reduce specific energy consumption (e.g., of the SWRO plant).

Pressure exchanger 300 may include one or more features configured to reduce mixing within the pressure exchanger 300 without having a negative impact on efficiency of the pressure exchanger 300 (e.g., minimizing decrease in efficiency, maintaining efficiency, increasing efficiency compared to pressure exchangers that do not have those features).

The features of pressure exchanger 300 (e.g., see end covers 310 of FIGS. 3A-H) may provide reduced rotor incidence losses (e.g., two ramps at entrance of port 312 to reduce incidence). Incidence may be an angle between ideal c velocity vector and actual c velocity vector.

Flow within ducts 322 of rotor 320 has both an axial velocity component (e.g., c(m)=w velocity component with two ramps of FIG. 3C) and a tangential velocity component (e.g., u-velocity component on FIG. 3C). The axial component may remain constant at any axial plane of the rotor 320, whereas the tangential component varies linearly with the radial coordinate. As the flow enters the rotor 320 through HPIN port and LPIN port (e.g., HPIN and LPIN kidneys), the flow may be accelerated to a velocity with a combination of axial and tangential velocity components, at all radii just before the fluid enters the ducts 322 of the rotor 320. Conventionally, shock losses due to oblique incidence can occur, resulting in flow separation and mixing due to enhanced eddy formation. End cover 310 forms ports 312 configured to guide the flow for a given nominal flow rate and a target RPM of rotor 320 that results in substantial reduction in mixing and reduction in pressure loss due to sudden change in flow direction.

In some embodiments, end cover 310 includes two ramps (e.g., a ramp at each radial sidewall 314) to provide substantial tangential flow velocity component in addition to the axial flow velocity component. In some embodiments, the end cover 310 has 3D ramps (e.g., further kidney geometry optimization) to provide smooth entry of fluid from port 312 to ducts 322 (e.g., see right side of FIG. 3C)

In some embodiments, an insert 330 (e.g., made of one or more components) may be embedded into the port 312 (e.g., see FIG. 3F). The insert 330 may be made of Alumina ceramic, plastics such as polycarbonate, fiber reinforced polytetrafluoroethylene (PTFE) and/or polyetheretherketone (PEEK), and/or the like.

End cover 310 of FIG. 3H may reduce effective width of the port 312 (e.g., kidney) by opening HPIN port 312 a few degrees later than baseline and thus reduces efficiency.

HPIN port may close earlier than HPOUT port (e.g., radial sidewalls 314 of HPIN port are closer to each other than radial sidewalls 314 of HPOUT). This may reduce mixing at HPOUT port caused by fluid inertia. Mixing at HPOUT port is undesirable when a pressure exchanger is used for energy recovery in particular applications (e.g., in an SWRO plant). The flow in the duct 322 of the rotor 320 accelerates as the duct 322 traverses across the HP ports. Average duct flow velocity starts from near-zero when the duct 322 opens to the HP ports and reaches a maximum just as it begins to exit the ports (e.g., kidneys).

Conventionally HPIN port and HPOUT port close at the same time (e.g., are the same size, radial sidewalls are same distance from each other). This may result in causing the duct flow to come to an abrupt halt during the short time for the fluid in the duct 322 to exit the port 312. Since the duct flow velocity is changed rapidly from a max value to near-zero in a very short time, inertia of the duct fluid may cause a large spike in local duct pressure. This may result in a fluid jet shooting out into the HPOUT port through the rapidly closing opening between the duct 322 and the HPOUT port. At that moment, the mixing zone (e.g., "liquid plug") may have traveled the maximum extent through the duct and may be proximate (e.g., very close) to the HPOUT port. Jets into HPOUT port may transport fluid from the mixing zone as well as some HPIN fluid behind the mixing zone into the HPOUT port, increasing undesirable mixing at HPOUT port.

The present disclosure may mitigate this mixing increase by closing the HPIN port a few degrees prior to the HPOUT port. This results in peak velocities being reached before the duct 322 closes to HPOUT port. Duct flow is decelerating when the fluid in the duct 322 exits the HPOUT port causing the pressure spike due to fluid inertia to decrease substantially. Jetting of mixing zone fluid into HPOUT port is greatly reduced, resulting in reduced mixing at HPOUT port.

HPIN port may open later than HPOUT port. Delaying the HPIN port opening after the HPOUT port biases the mean location of the two-fluid interface closer to the HPIN port than the LPIN port. This helps move the interface away from HPOUT and reduces mixing of HPIN at HPOUT. This feature can be selectively utilized when reducing mixing is a higher priority and slight tradeoff in efficiency is acceptable. Delaying HPIN opening a few degrees with respect to HPOUT can move the interface away from HPOUT and this may reduce mixing at HPOUT.

The kidney exit ramps (e.g., radial sidewalls 314) of the end covers 310 may be configured to guide flow into HPOUT and LPOUT ports while minimizing shock losses at exit (e.g., shock losses due to flow separation).

Flow exiting ducts 322 of rotor 320 into outlet ports (e.g., outlet ports, HPOUT port and LPOUT port) has both axial and tangential components of velocity. Axial velocity component may not vary much with radius, but tangential velocity component scales linearly with radius. Outlet port walls may be configured to provide duct flow smoothly exiting through the ports without any separation. The sidewalls of the end cover 310 that form the ports 312 may be configured to accommodate the varying ratio of tangential and axial components of velocity with radius. By preventing flow separation at exit, both differential pressure (DP) losses and mixing losses are reduced (e.g., mixing zone may be closest to the duct exit at outlet ports).

Spot faces 340 may be located to reduce mixing (e.g., see FIGS. 3L-0). Spot faces 340 may be used on ports 312 to gradually pressurize or depressurize a duct 322 of a rotor 320 (e.g., instead of abrupt pressure equalization through high velocity jetting into or out of the rotor duct). Spot faces 340 reduce the jetting velocity due to pressure differential between the duct 322 and the port 312 by adding resistance to flow through the narrow gap. In some embodiments, the spot faces 340 are located on HPOUT port without being located in HPIN port. This may compensate for the depth of the spot face 340 and pressure equalization may be achieved by jets of HPOUT fluid entering the low-pressure rotor duct instead of HPIN fluid. The "liquid plug" may be farthest away from HPOUT port when the pressure equalization occurs and mixing is reduced.

In some embodiments, second fluid (e.g., exiting HPOUT port, HPOUT fluid) may be used as bearing fluid and/or centerbore fluid. In a pressure exchanger 300 (e.g., rotary pressure exchanger), first fluid (e.g., HPIN fluid) or second fluid (e.g., HPOUT fluid) may be used as bearing fluid for radial and axial bearings. If the pressure differential between HPIN and HPOUT fluids meets a threshold amount (e.g., is small), bearing performance (e.g., stiffness and load capacity) may not change appreciably with choice of either of the fluids. If the pressure differential between HPIN and HPOUT fluids meets a threshold amount (e.g., is small), HPOUT fluid may be used as the bearing fluid and may reduce mixing at HPOUT port. By feeding the radial and axial bearings with HPOUT fluid, HPIN fluid may be isolated preventing the chance of increased mixing through leakage from the bearing gaps.

HPOUT fluid may be used to feed pressure exchanger radial bearings and to fill the centerbore of the rotor (e.g., see FIGS. 3I-J).

Referring to FIG. 3I, PX 300 may include a fluid bypass 350 (e.g., HPOUT fluid bypass), according to certain embodiments. Fluid may enter between the housing 352 and end cover 310 (e.g., LPIN end cover) and flow between housing 352 and sleeve 301 and via an opening in sleeve 301 (e.g., to feed pressure exchanger radial bearings and/or to fill the center bore). In some embodiments, fluid bypass 350 (e.g., HPOUT fluid bypass) may go around a gasket (e.g., O-ring) between housing 352 and end cover 310 to feed the PX radial bearings through a hole in the sleeve.

Referring to FIG. 3J, PX 300 may include a fluid bypass 350 (e.g., HPOUT fluid bypass) and/or slot 354, according to certain embodiments. The fluid bypass 350 may be an HPOUT fluid bypass of gasket (e.g., O-ring) and may feed the PX radial bearings through a hole in the sleeve. Slot 354 in end cover 310 (e.g., HPOUT end cover) may be used to communicate HPOUT fluid to center bore 356 (e.g., central portion of rotor 320, between rotor 320 and shaft).

In some embodiments, the length to diameter (L/D) ratio and the roundness of the ducts 322 are maximized. Mixing in a rotor duct may be a strong function of turbulence, the influence of which can be reduced significantly be controlling the L/D ratio and the roundness of the ducts. Inserts may be added to the rotor 320 to achieve a desired duct shape, achieve near "liquid plug" flow, and reduce mixing in the rotor ducts.

The present disclosure may be employed in rotary pressure exchangers to reduce mixing of the two fluids across which pressure energy is being exchanged.

The present disclosure may include features such as ramps (e.g., kidney ramps), spot faces 340, filets, etc. (e.g., to reduce mixing).

The present disclosure reduces the mixing of fluids in a pressure exchanger and improves overall energy consumption per unit volume (e.g., of potable water produced in a SWRO plant). The present disclosure is applicable for different pressure exchanger (e.g., isobaric pressure exchanger) applications, such as SWRO, sCO2, industrial wastewater, etc. The present disclosure may also be applicable for pressure exchanger architectures, such as a PX with rotor-sleeve or sleeveless pressure exchanger (e.g., rotor with center-post) and motorized or non-motorized PX. The present disclosure can be applied appropriately for different applications to reduce mixing of LPIN into LPOUT as well.

FIGS. 4A-K illustrate components of pressure exchangers 300 (e.g., PXs 40 of FIGS. 2A-E, pressure exchanger 300 of one or more of FIGS. 3A-P), according to certain embodiments. Features in FIGS. 4A-K that have similar names and/or reference numbers as features in one or more of FIGS. 1A-2E and/or one or more of FIGS. 3A-P may include the same or similar structure, material, functionality, and/or the like as features in one or more of FIGS. 1A-2E and/or one or more of FIGS. 3A-P. In some embodiments, one or more features of PX 300 of FIGS. 4A-K increase efficiency of PX 300.

In some embodiments, a pressure exchanger 300 includes a rotor 320 and end covers 310. The rotor 320 is configured to rotate to exchange pressure between a first fluid at a first pressure and a second fluid at a second pressure. The rotor 320 forms ducts 322 that are routed from a first distal end of the rotor 320 to a second distal end of the rotor 320.

In some embodiments, radial edge of kidney entrance and exits of end cover 310 may matching that of the rotor 320.

In some embodiments, PX 300 uses a streamlined (lofted) spacer in end cover 310.

In some embodiments, non-metallic PVC spacer is used in PX 300 to handle axial thrust and to avoid fretting corrosion between ceramic end cover 310 and metallic interconnect.

In some embodiments, radial and axial bearing clearances are optimized for target circumference groove pressure.

In some embodiments, the ports of end cover 310 are maximized to be substantially the same size as one duct 322 plus one wall sealing area of rotor 320 to reduce difference in pressure (DP) losses.

In some embodiments, pressure loads are substantially balanced on both rotor faces of rotor 320.

In some embodiments, duct shape of ducts 322 substantially matches ports (e.g., kidneys) of end covers 310 (e.g., trapezoidal or triangular instead of circular).

In some embodiments, an end cover 310 (e.g., a first end cover) is disposed at a distal end (e.g., the first distal end) of the rotor 320 and the end cover 310 forms a HPIN port configured to provide the first fluid at the first pressure into the ducts 322 and forms a LPOUT port configured to receive the first fluid from the ducts 322 at a third pressure that is lower than the first pressure. One or more sidewalls (e.g., radial sidewalls 314) of the end cover that form the HPIN port and/or the LPOUT port are substantially planar (e.g., straight edge 401, not curved edge 402) (e.g., see FIG. 4B). In some embodiments, the one or more sidewalls of the first end cover 310 that form the HPIN port have a substantially straight edge 401 that substantially matches a corresponding substantially straight edge of a duct 322 formed by the rotor 320.

In some embodiments, an end cover 310 is disposed at a distal end (e.g., second distal end) of the rotor 320 and the end cover forms a LPIN port configured to provide the second fluid at the second pressure into the ducts 322 and forms a HPOUT port configured to receive the second fluid from the ducts 322 at a fourth pressure that is higher than the second pressure.

In some embodiments, the end cover 310 (e.g., that forms HPIN port and LPOUT port, that forms LPIN port and HPOUT port) includes substantially planar radial sidewalls 314 (e.g., non-curved radial sidewalls 314), an inner sidewall 316, and an outer sidewall 318 that form the port 312 (e.g., HPIN port, HPOUT port). The first substantially radial sidewalls 314 may be disposed between a center of the end cover 310 and a perimeter of the end cover 310. The inner sidewall 316 may be proximate the center of the end cover 310 and the outer sidewall 318 may be proximate the perimeter of the end cover 310.

Figure 4B:
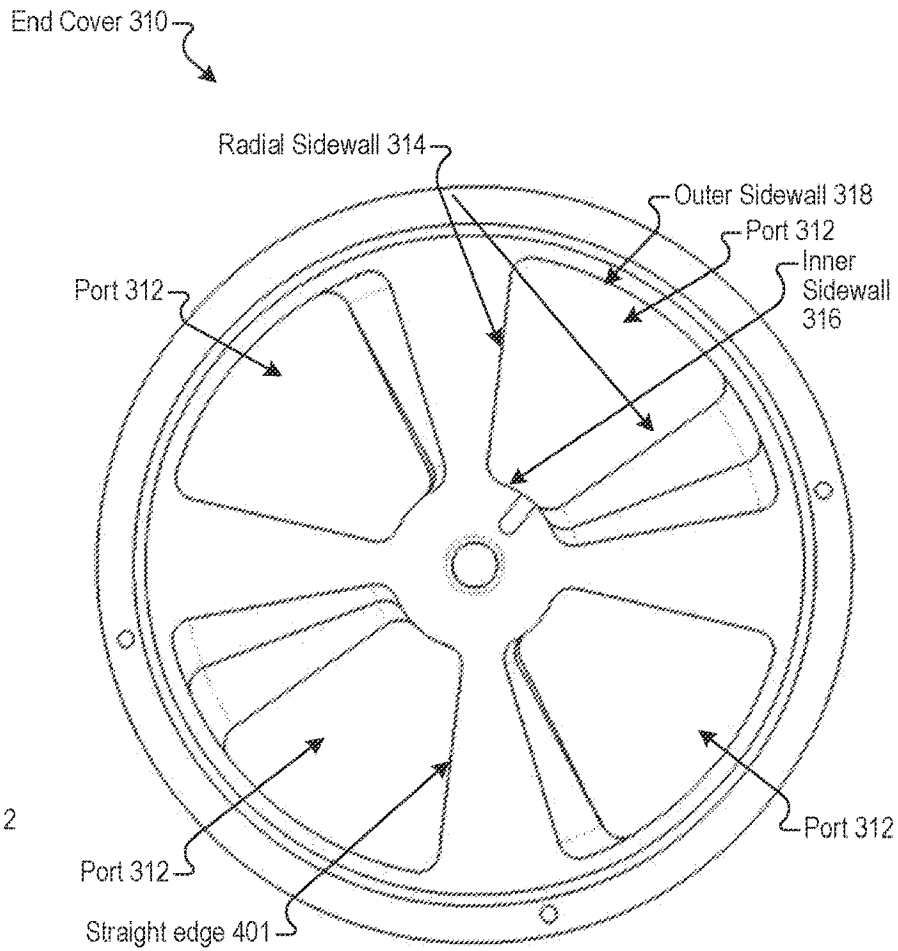
FIGS. 4A-K illustrate components of pressure exchangers, according to certain embodiments.
Figure 4A:
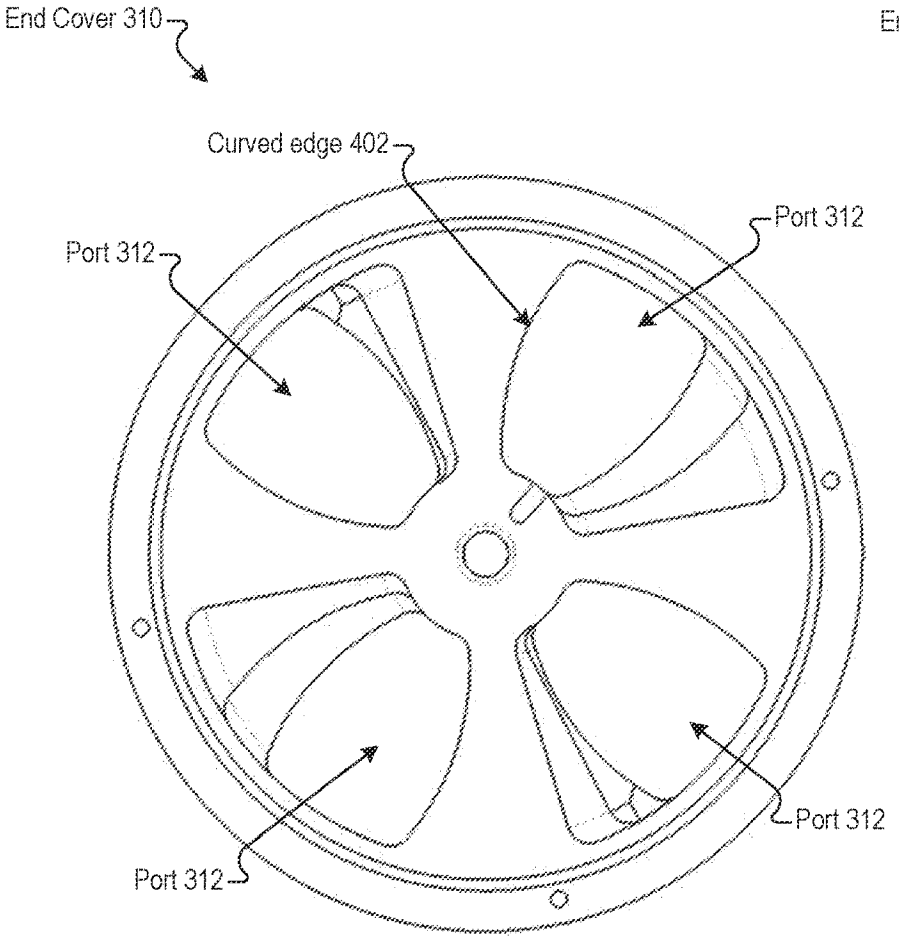
Figure 4D:
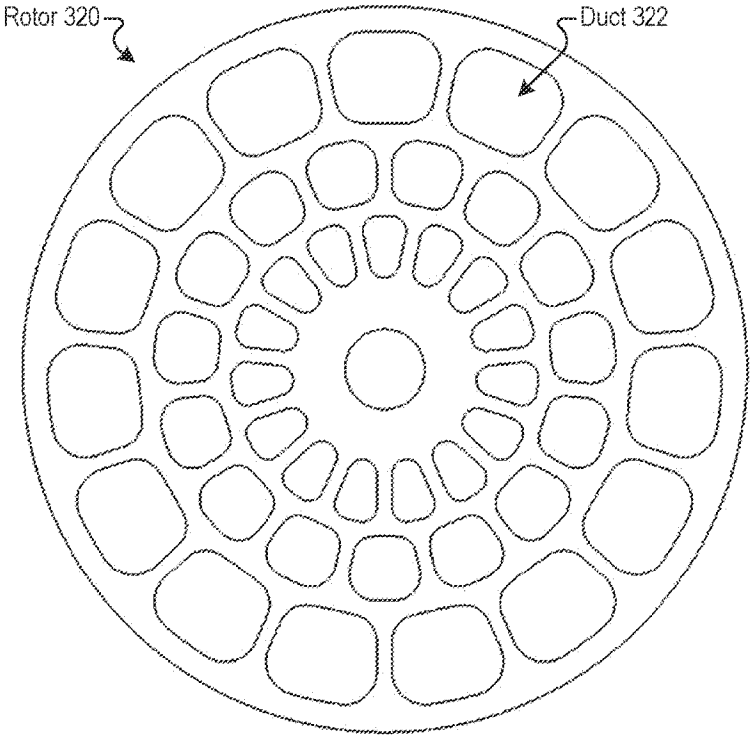
Figure 4C:
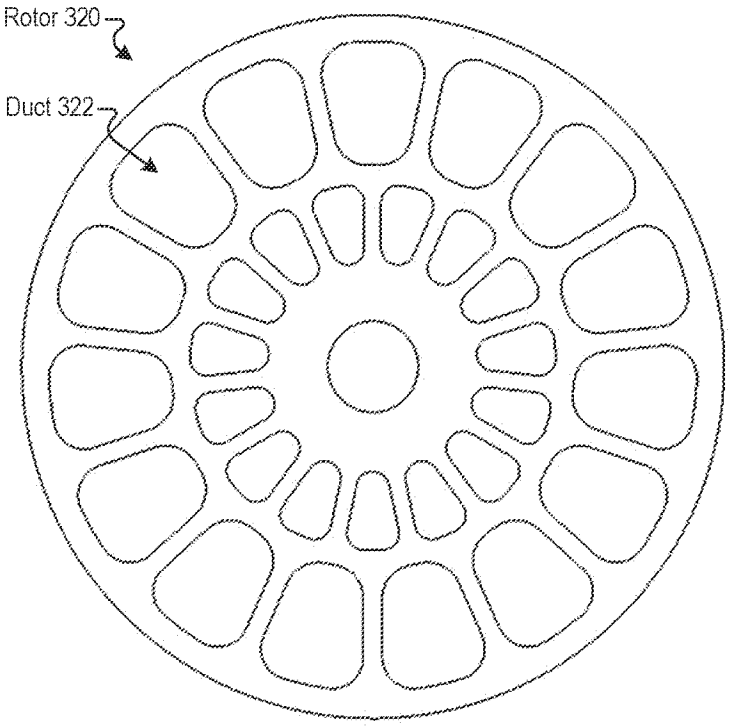
Figure 4E:
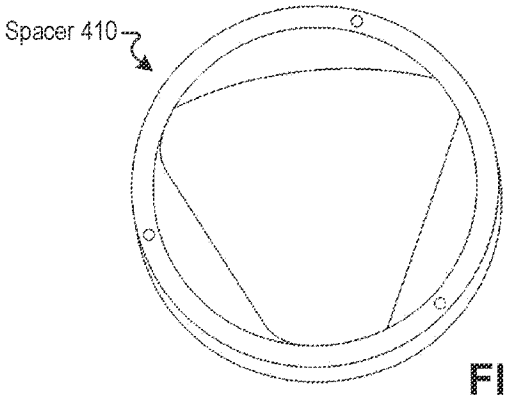

The rotor 320 may form ducts 322 in concentric rows (e.g., see FIGS. 4C-D). A ratio of a number of the concentric rows to inches of diameter of the rotor 320 may be about 0.3 to about 0.45 (e.g., from about 0.375 to about 0.42). The rotor 320 may form the ducts 322 in at least three concentric rows.

Figure 4F:
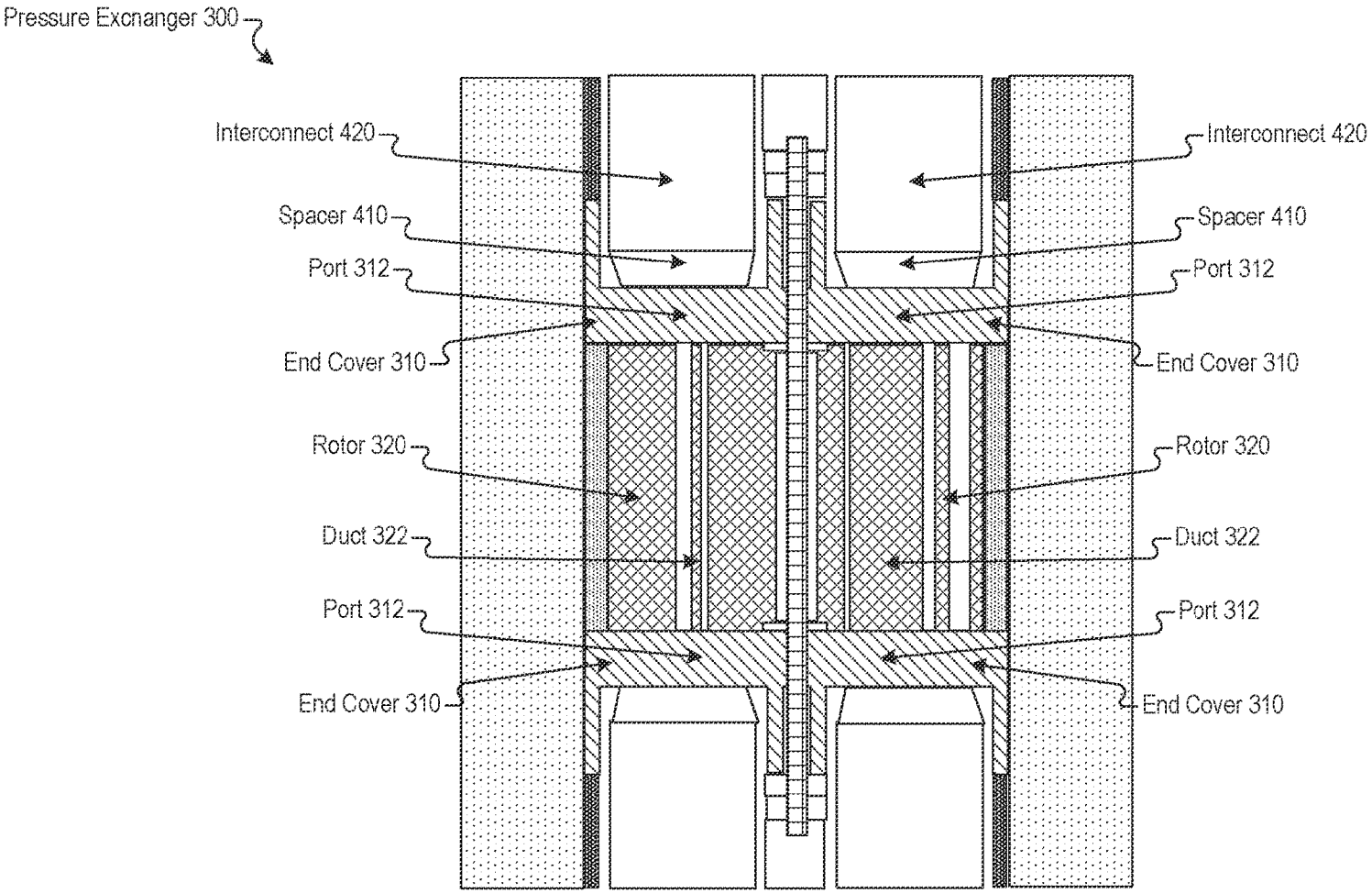

The pressure exchanger 300 may include a first interconnect 420 configured to provide the first fluid to the HPIN port of the end cover 310, a first spacer 410 (e.g., see FIG. 4E) disposed in the end cover 310 between the first interconnect and the HPIN port (e.g., see FIG. 4F). The pressure exchanger 300 may include a second interconnect 420 configured to receive the first fluid from the LPOUT port of the end cover 310 and a second spacer 410 disposed in the first end cover between the LPOUT port and the second interconnect (e.g., see FIG. 4F). In some embodiments, the first spacer and/or the second spacer are a thermoplastic material. In some embodiments, the first spacer and/or the second spacer are polyvinyl chloride (PVC).

Figure 4G:
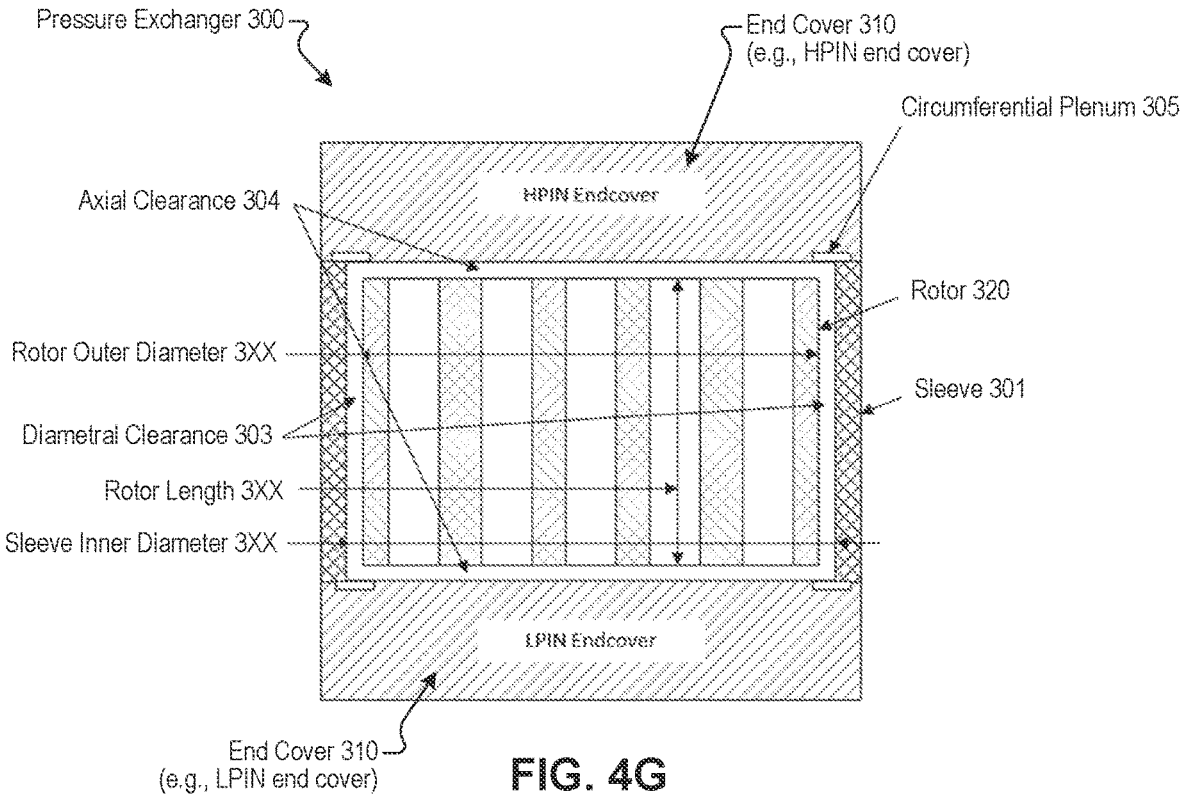
Figure 4H:
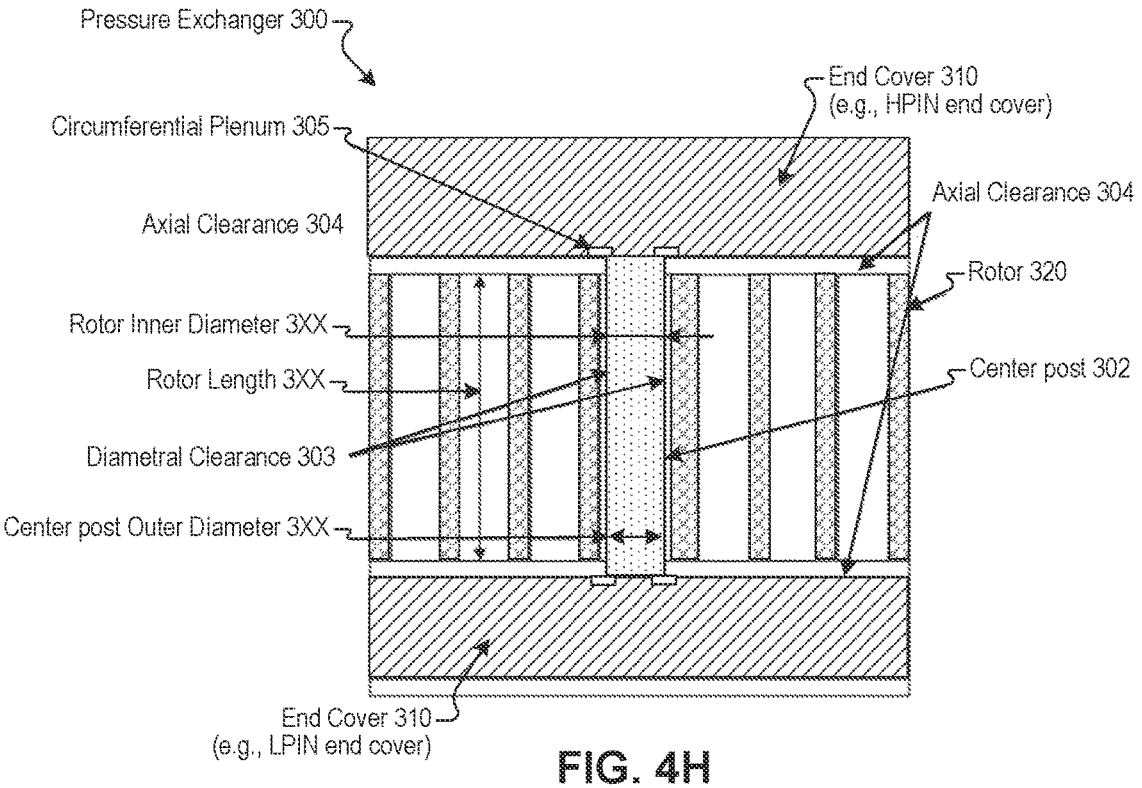

FIGS. 4G-4H illustrate PXs 300, according to certain embodiments. In some embodiments, a PX 300 may have bearing stiffness tuned to center the rotor 320 and to reduce leakage by optimizing diametral clearance 303 (e.g., radial clearance) and axial clearance 304 (e.g., axial bearing clearance, a height difference between the sleeve and the rotor or between the center post and the rotor) for target circumferential groove pressure.

In PX 300 (e.g., a rotary pressure exchanger), the rotor 320 is separated from the stator (e.g., end cover 310, sleeve 301) with a small clearance both radially (e.g., diametral clearance 303 between the sleeve 301 and rotor 320 or center post 302 and rotor 320) and axially (e.g., axial clearance 304 between end covers 310 and rotor 320). During operation, the rotor 320 is suspended in the clearance by the stiffness of the fluid film in the radial and axial bearings generated by hydrodynamic and hydrostatic effects respectively. For minimal bearing flows (leakage loss), the rotor 320 is to have minimal clearances and the rotor 320 is to be centered axially (e.g., with smallest axial eccentricity). Minimal clearances are set by manufacturing and material stiffness limitations. Minimal eccentricity can be achieved by maintaining the ratio between the diametral clearance 303 and axial clearance 304 within a narrow range of about 1 to about 3.5. Such an arrangement may provide an intermediate plenum pressure (e.g., the optimal intermediate plenum pressure) (e.g., in circumferential plenum 305) between the two bearings resulting in lower axial rotor eccentricity (e.g., lowest axial rotor eccentricity) and in so doing, minimize leakage loss.

In some embodiments, a ratio of diametral clearance 303 (e.g., diametric clearance, diametric clearance, radial clearance, etc.) to axial clearance 304 is about 1 to about 3.5. The diametral clearance 303 is between the rotor 320 and a sleeve 301 or between the rotor 320 and a center post 302. The axial clearance 304 is between the rotor 320 and an end cover 310.

Figure 4I:
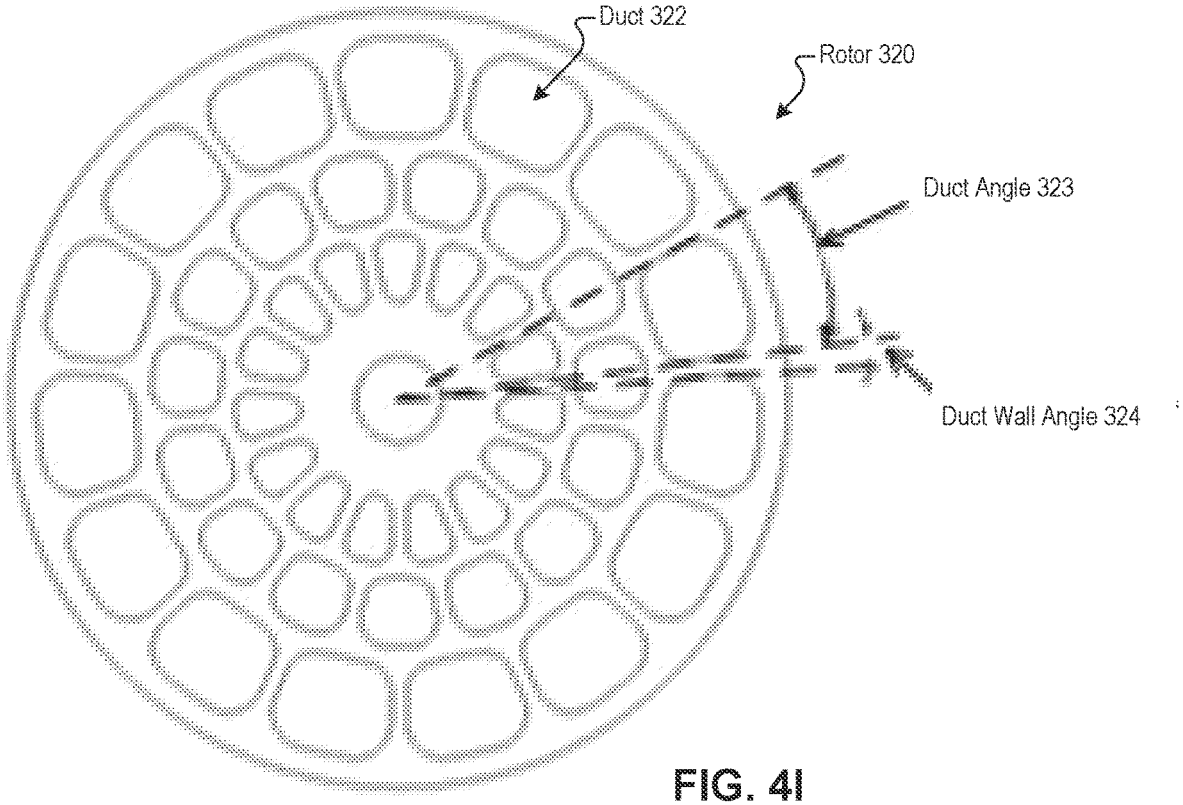
Figure 4J:
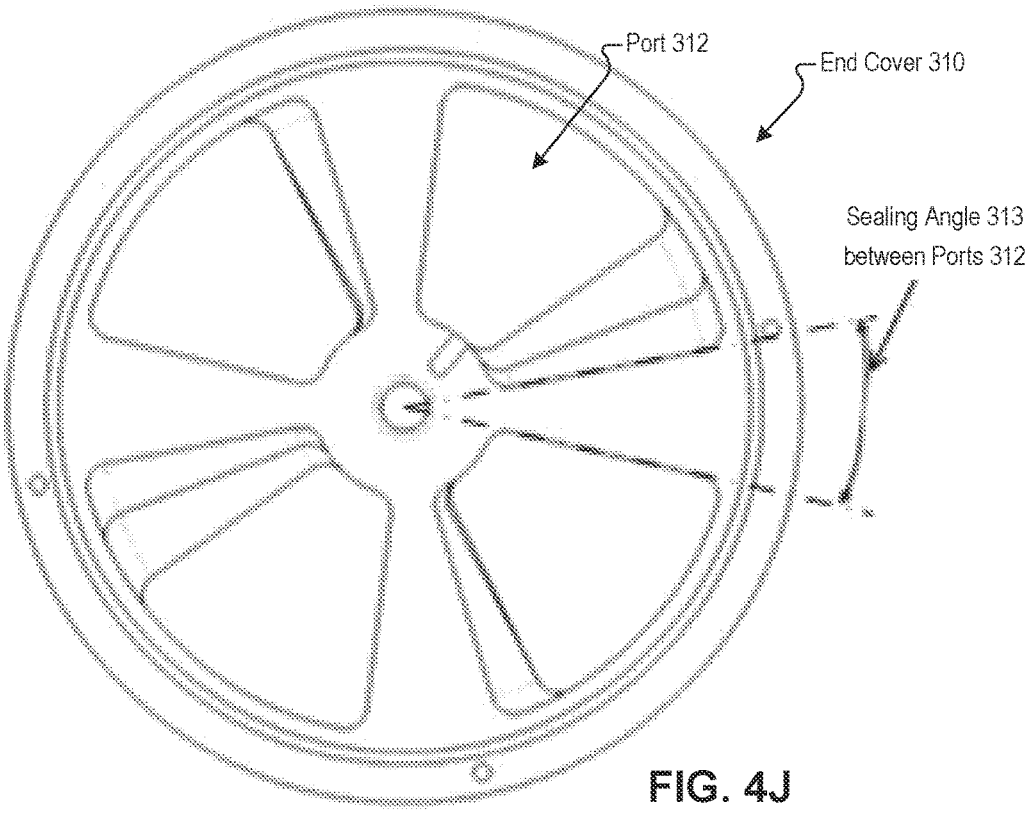
Figure 4K:
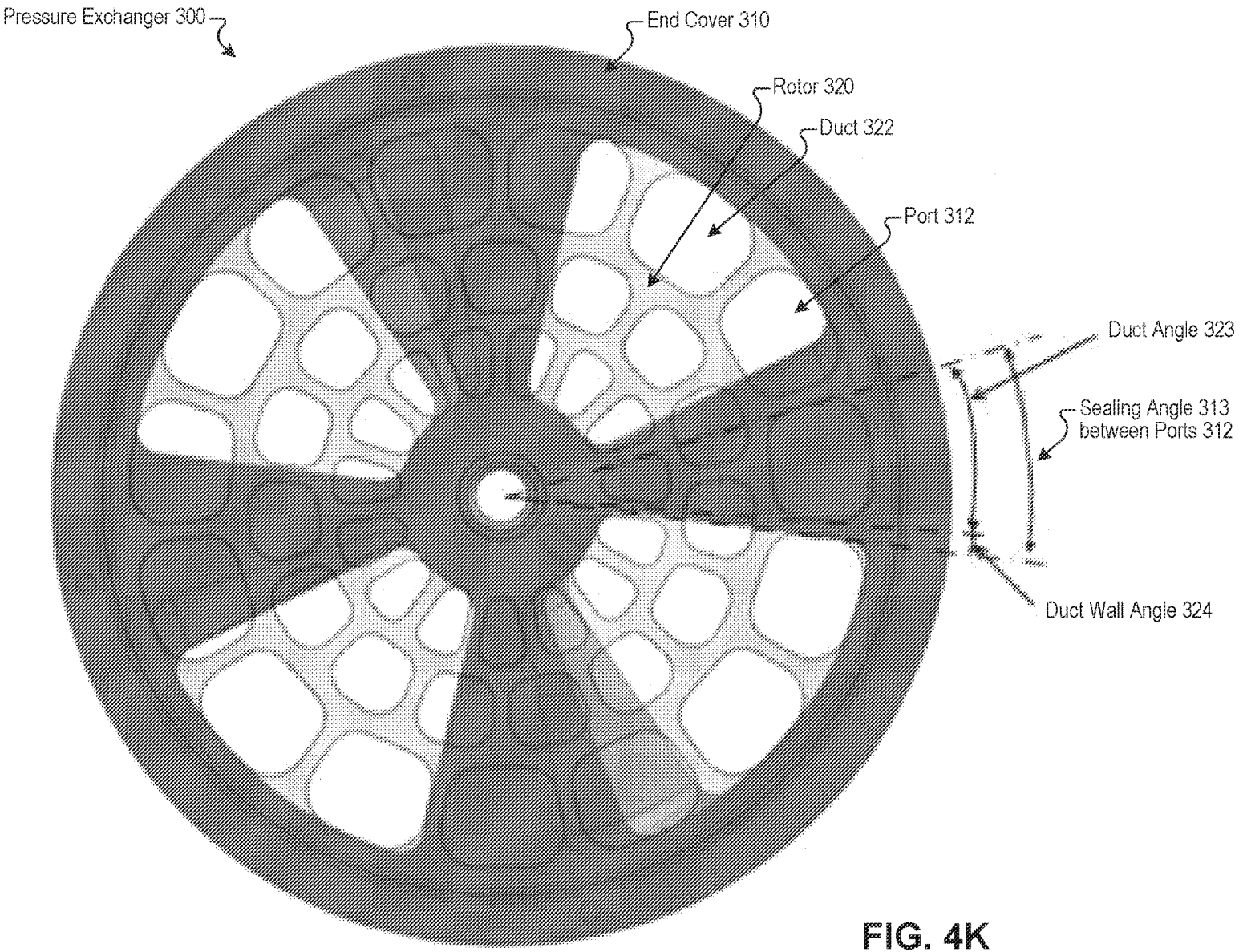

FIG. 4I illustrates a rotor 320, according to certain embodiments. FIG. 4J illustrates an end cover 310 according to certain embodiments. FIG. 4K illustrates a PX 300 with rotor 320 superimposed on end cover 310, according to certain embodiments. As shown in FIGS. 4I-K, sealing angle 313 between ports 312 of end cover 310 may be at least the same as the duct angle 323 plus duct wall angle 324 of rotor 320.

In some embodiments, angular spacing between the HPIN port and the LPOUT port of the first end cover 310 substantially matches corresponding angular spacing between a first leading radial sidewall of a first duct 322 of the rotor 320 and a second leading radial sidewall of a second duct 322 that is adjacent to the first duct 322.

Fluid flow in the ducts of a rotary pressure exchanger may be unsteady with rapid acceleration and deceleration in both directions during each rotation. This results in a pressure loss across the rotor required to overcome fluid inertia. Apart from reducing rotor speed (which can result in increased mixing), this inertial pressure loss can also be minimized by maximizing the flow area of the kidneys (e.g., ports 312 of end cover 310). This results in lower acceleration for the same flow rate which provides a reduction in inertial pressure loss. To prevent direct communication from one kidney to the next (e.g., between ports 312), a minimum amount of sealing angle of end cover 310 may be maintained substantially equivalent (e.g., equivalent) to the angular spacing between the ducts 322 (duct angle 323 plus duct wall angle 324).

The present disclosure may optimize a pressure exchanger 300 (e.g., isobaric pressure exchanger) for efficiency, mixing, cavitation, sound, and cost.

Conventionally, features that attempt to increase efficiency by increasing travel distance end up increasing mixing inside the pressure exchanger. The present disclosure may maximize efficiency at a similar travel distance as conventional pressure exchangers without having a negative impact on mixing performance (e.g., by maintaining the same amount of mixing, by decreasing mixing, etc.).

The present disclosure may be used in different pressure exchanger (e.g., isobaric pressure exchanger) applications (e.g., using a pressure exchanger for energy recovery), such as SWRO, sCO2, industrial waste water, etc. The present disclosure may be used in different pressure exchanger architectures, such as a pressure exchanger with rotor-sleeve or sleeveless pressure exchanger (e.g., rotor with center-post) and motorized or non-motorized pressure exchanger.

The present disclosure may be used to reduce fluid inertial pressure loss using radial edge of the port 312 (e.g., kidney) entrance and exits. Conventionally, a substantially amount of the pressure loss in the rotor 320 occurs due to sudden acceleration and deceleration of flow inside the rotor 320. The differential pressure to accelerate the flow inside the duct 322 of the rotor 320 (e.g., pressure lost in accelerating the flow inside the rotor ducts in terms of dQ/dt) may be given as shown in Equation 1.

$$\Delta P_{fluid_inertia}=(\rho_{fluid}*L_{duct}/A_{duct})*(dQ_{duct}/dt) \quad \text{Equation 1}$$

$Q_{duct}$ is the flow through each duct 322.

$dQ_{duct}/dt$ is the rate of change of flow in the duct 322 (e.g., acceleration, deceleration).

$L_{duct}$ is the length of the duct 322.

$A_{duct}$ is the area of the duct 322.

dt is the time the duct 322 is open to the port 312 (e.g., kidney).

$dP_{fluid_inertia}$ (e.g., $\Delta P_{fluid_inertia}$) is the pressure loss in the fluid due to acceleration and/or deceleration.

Since $dt=\omega*d\theta$, Equation 1 can be re-written as Equation 2 (e.g., pressure lost in accelerating the flow inside the rotor ducts in terms of $dQ/d\theta$).

$$\Delta P_{fluid_inertia}=(\rho_{fluid}*L_{duct}/A_{duct}/\omega)*(dQ_{duct}/d\theta) \quad \text{Equation 2}$$

Per Equation 2, the $dP_{fluid_inerta}$ (e.g., $\Delta P_{fluid_inertia}$) can be decreased by reducing the $dQ/d\theta$ term.

Conventional end covers may have curved-edge sidewalls that form the ports. In some embodiments, end covers 310 of the present disclosure include substantially planar radial sidewalls 314 (e.g., radial-edge end covers 310). Using a radial-edge port may cause an effective kidney angle for the middle and outer-most ducts to be increased as compared to curved-edge ports (e.g., by about 26% for outer-most duct). The radial edge of the port 312 may cause the trapezoidal shape of the port 312 to match the trapezoidal shape of ducts 322 of rotor 320.

In some embodiments, fluid inertial pressure loss may be reduced by maximizing rotor flow with selection of number and shape of rotor ducts. In a rotor 320, duct passage-ways help convey flow from the inlet to the outlet ports. Most amount of pressure losses may occur in the rotor 320. Increasing the rotor duct flow area may reduce pressure loss, without having a negative impact on mixing. The constraint may be that stress are to be below the material strength of the rotor 320.

In some embodiments, the rotor 320 has trapezoidal shaped ducts 322 with large fillets to make use of available area by maximizing duct flow area and preventing high stress concentrations (e.g., see FIG. 4D).

In some embodiments, the number of concentric rows is selected to maximize the total duct flow area, while also minimizing the maximum duct area and meeting the strength criteria of the material. This also helps achieve effective hydraulic diameter similar to an equivalent circle (e.g., prevents high aspect ratio ducts).

In some embodiments, the rotor 320 has an odd number of ducts 322 (e.g., a non-even number of ducts). This prevents opening of a duct 322 to symmetrically opposite ports 312 at the same time which reduces noise and vibration of the pressure exchanger 300.

In some embodiments, the rotor 320 has staggered ducts which reduces the total amount of duct volume that pressurizes and/or depressurizes at a time which reduces noise and vibration of the pressure exchanger.

In some embodiments, the rotor 320 has at least two concentric rows of ducts 322. In some embodiments, the rotor 320 has at least three concentric rows of ducts 322.

In some embodiments, a spacer (e.g., lofted spacer, streamlined spacer) is used to provide the flow into the HPOUT port and the LPOUT port is guided to minimize shock losses at exit due to flow separation.

Flow exiting rotor ducts into outlet ports has both axial and tangential components of velocity. Axial velocity component may not vary much with radius of the rotor 320. Tangential component scales linearly with radius. Outlet port (e.g., LPOUT port, HPOUT port) walls may be designed so that the duct flow exits smoothly through the ports 312 without separation. The port sidewalls (e.g., kidney walls) may be configured to accommodate the varying ratio of tangential and axial components of velocity with radius. By preventing flow separation at exit, both pressure differential losses and mixing losses are reduced. The mixing zone may be closest to the duct exit at outlet ports (e.g., outlet kidneys) of the end covers 310.

A spacer 410 (e.g., streamlined spacer, streamlined lofted spacer) may be used to reduce pressure loss. In some embodiments, a spacer may be used to eliminate the use of a thrust ring and/or to reduce pressure losses due to sudden change in area between LP ports and interconnects. A spacer 419 (e.g., lofted spacer) may be used to streamline flow and to avoid pressure loss due to sudden change in area. In some embodiments, PX 300 may include a spacer 410 that has a lofted shape that transitions from a round shape of an interconnect to a non-round shape of a corresponding port of the first end cover 310.

A non-metallic spacer 410 (e.g., non-metallic streamlined spacer) may be used to handle axial thrust and to avoid fretting corrosion between ceramic end cover 310 and metallic interconnects (e.g., end covers 310 used with interconnects without a spacer 410 may have fretting corrosion issues). A spacer 410 (e.g., streamlined spacer) may be made out of polyvinyl chloride (PVC) (e.g., to eliminate need for a thrust ring used in conventional pressure exchangers). The thrust ring transmits axial force from the ceramic cartridge to the housing through the seal plate and bearing plate. The use of a spacer 419 made of PVC (e.g., injected molded to reduce cost) acts as buffer material between metallic LP interconnects and the ceramic end cover 310. This allows the freedom to select the LP interconnect material to any material (e.g., 2507 super duplex, AL6XN, etc.) compatible with the fluid of the application (e.g., seawater application) and for the rated pressure.

In some embodiments, leading radial sidewalls and trailing radial sidewalls of the LPOUT port and the HPOUT port are not axial. The leading radial sidewalls and the trailing radial sidewalls of the LPOUT port and the HPOUT port may be inclined at an angle that is substantially proportional to rotor revolutions per minute. The angle may be about 30 degrees to about 70 degrees.

Fluid acceleration and deceleration (e.g., fluid inertia) losses may be reduced by: increasing time available to fill rotor ducts by increasing effective angular extent of the port by making port edges radial (e.g., substantially planar radial sidewalls 314); minimizing peak fluid velocity (e.g., V_max) inside the rotor 320 by maximizing rotor flow area while meeting stress and manufacturing constraints.

In some embodiments, a spacer 410 (e.g., lofted spacer) helps reduce fretting corrosion between super duplex or stainless steel metals and Aluminum oxide ($Al_2O_3$) and may streamline flow in and out of the ports which reduces frictional fluid losses. This may avoid using more exotic materials for the interconnect 420 such as titanium. The spacer (e.g., lofted spacer) may combine three functions of streamlining flow and reducing fluid loss due to sudden area change, acts as a compliant material between metal interconnect 420 and brittle ceramic, and also handles the net thrust of the cartridge due to pressure imbalance. This may prevent use of a separate thrust ring.

Features, such as trapezoidal ducts 322, odd number of ducts 322, at least three concentric rows of ducts 322 while maintaining single duct volume at a minimum, and/or the like may be used to maximize rotor efficiency.

FIGS. 5A-J illustrate components of pressure exchangers 300 (e.g., PXs 40 of FIGS. 2A-E, pressure exchanger 300 of one or more of FIGS. 3A-4K), according to certain embodiments. Features in FIGS. 5A-J that have similar names and/or reference numbers as features in one or more of FIGS. 1A-2E and/or one or more of FIGS. 3A-4K may include the same or similar structure, material, functionality, and/or the like as features in one or more of FIGS. 1A-2E and/or one or more of FIGS. 3A-4K. In some embodiments, one or more features of PX 300 of FIGS. 5A-J reduce cavitation and/or noise of PX 300.

A pressure exchanger includes a rotor 320 and end covers 310. The rotor 320 is configured to rotate to exchange pressure between a first fluid at a first pressure and a second fluid at a second pressure. The rotor 320 forms ducts 322 that are routed from a first distal end of the rotor 320 to a second distal end of the rotor 320.

An end cover 310 (e.g., disposed at a distal end of the rotor 320) forms an HPIN port configured to provide the first fluid at the first pressure into the ducts 322 and forms an LPOUT port configured to receive the first fluid from the ducts 322 at a third pressure that is lower than the first pressure.

In some embodiments, PX 300 includes a spot face at LPIN open instead of LPOUT open (e.g., to cause depressurization of HP duct to occur at LPIN which is at a higher pressure than LPOUT).

In some embodiments, duct opening to the spot face at duct ID instead of duct OD (e.g., adjusting angle of spot face edge or curving the spot face wall towards or away from duct).

In some embodiments, spot faces with radial extent shorter than that of the duct 322 (e.g., reduces the diameter at which duct will open to kidney, reduces tangential velocity and cavitation potential.

In some embodiments, PX 300 includes split spot faces (e.g., at one or more end covers 310). There may be one split spot face per row of ducts or combined for a set of ducts. This may tune spot face for each row of ducts 322 separately.

In some embodiments, PX 300 has optimized duct volume and staggering ducts in adjacent rows.

In some embodiments, spot face geometries may have: (a) substantially constant depth spot face; (b) substantially linear depth spot face; (c) step out EC (end cover); and/or (d) pre-pressurization hole.

In some embodiments, spot face angular extent, radial extent, and ramp angle may be optimized for different fluids and operating conditions.

In some embodiments, rotor 320 may include chamfers on trailing edge of rotor duct walls to increase coefficient of discharge (Cd).

An end cover 310 (e.g., disposed at a distal end of the rotor 320) forms an LPIN port configured to provide the second fluid at the second pressure into the ducts 322 and forms an HPOUT port configured to receive the second fluid from the ducts 322 at a fourth pressure that is higher than the second pressure (e.g., FIG. 5B). The end cover 310 forms a first spot face 340 proximate the LPIN port and a second spot face 340 proximate the HPOUT port.

In some embodiments, an end cover 310 forms the LPOUT port without forming a spot face 340 proximate the LPOUT port and forms the HPIN port without forming a spot face 340 proximate the HPIN port (e.g., FIG. 5A).

In some embodiments, for SWRO, a spot face 340 is formed proximate LPIN port and a spot face 340 is formed proximate HPOUT port to minimize mixing at HPOUT port (e.g., without forming a spot face at LPOUT which could cause cavitation since LPOUT pressure is below a threshold pressure).

In some embodiments, for refrigeration, a spot face 340 is formed proximate LPOUT port and a spot face 340 is formed proximate HPOUT port to reduce mixing at LPOUT port and HPOUT port (e.g., LPOUT pressure is above a threshold pressure so risk of cavitation is low).

In some embodiments, end cover 310 forms a chamfer 311 at the LPIN port that is configured to change a corresponding angle of the first spot face 340 for each concentric row of the ducts of the rotor 320 (e.g., see FIG. 5C). The chamfer 311 at the LPIN port is configured to change a corresponding angle for each duct to be exposed to the spot face to change an amount of pressurization (e.g., pressurization and/or depressurization) of different rows of ducts.

Figure 5D:
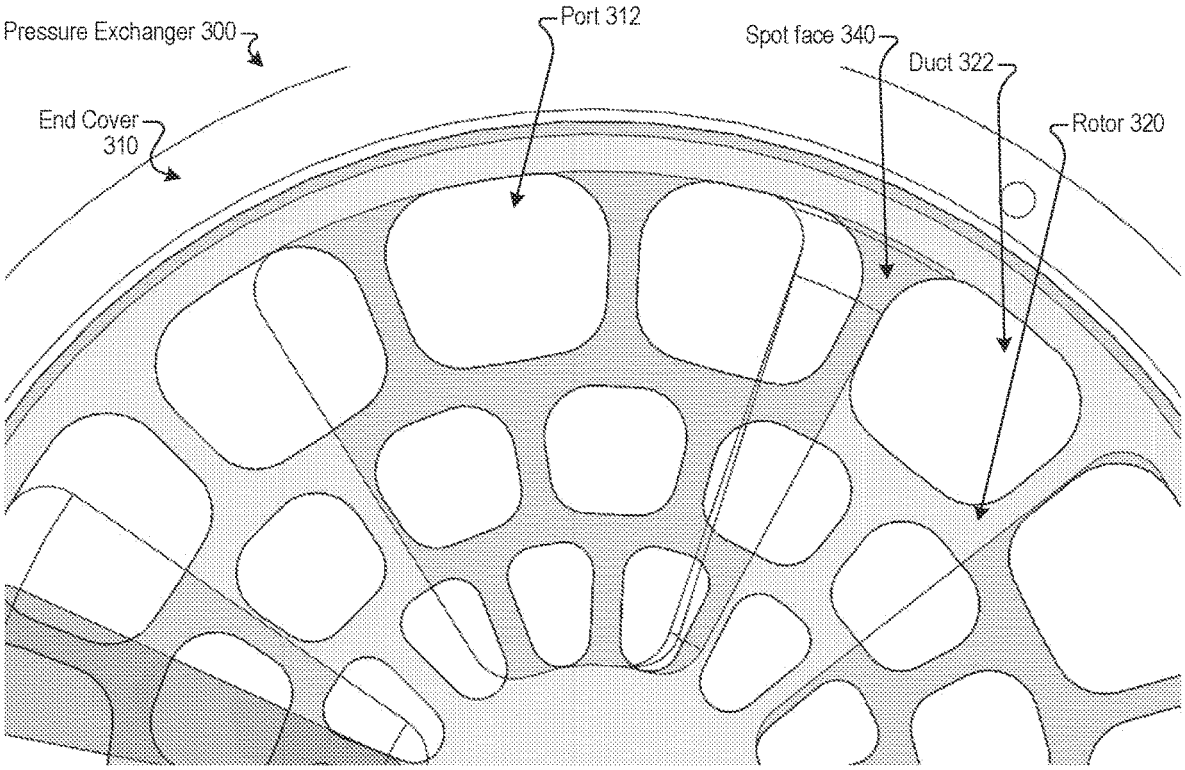
Figure 5E:
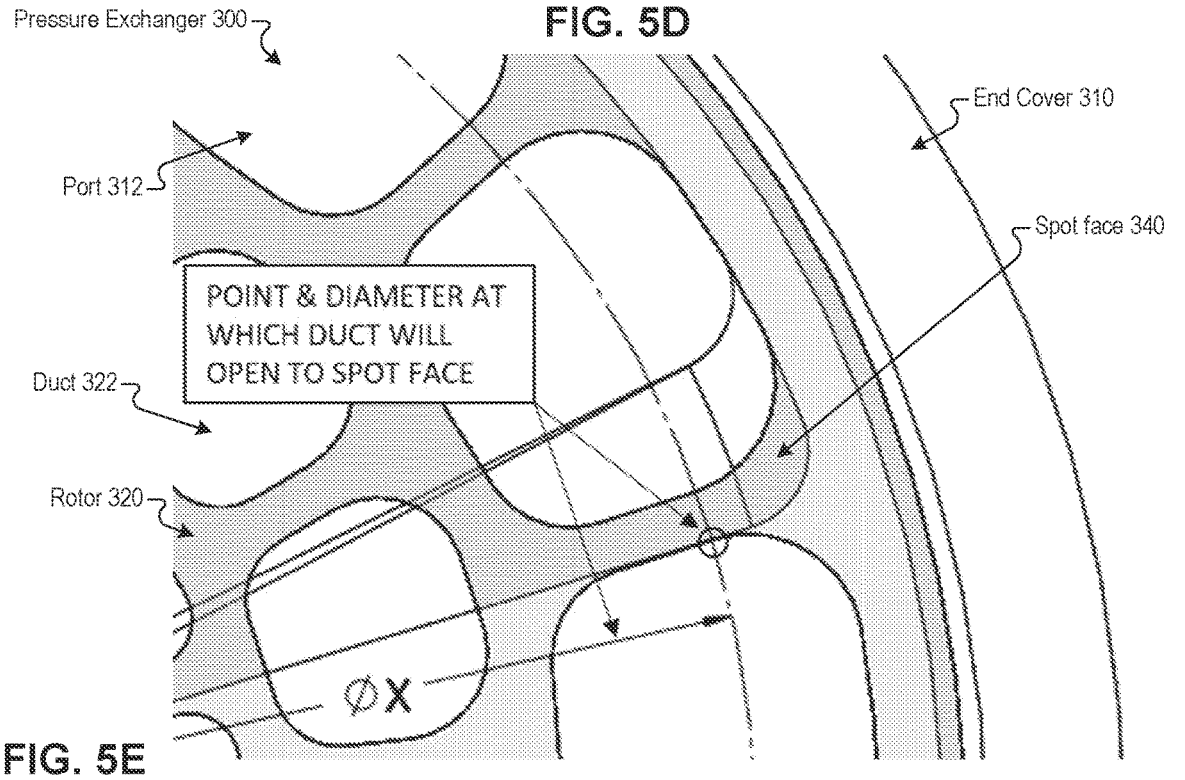
Figure 5F:
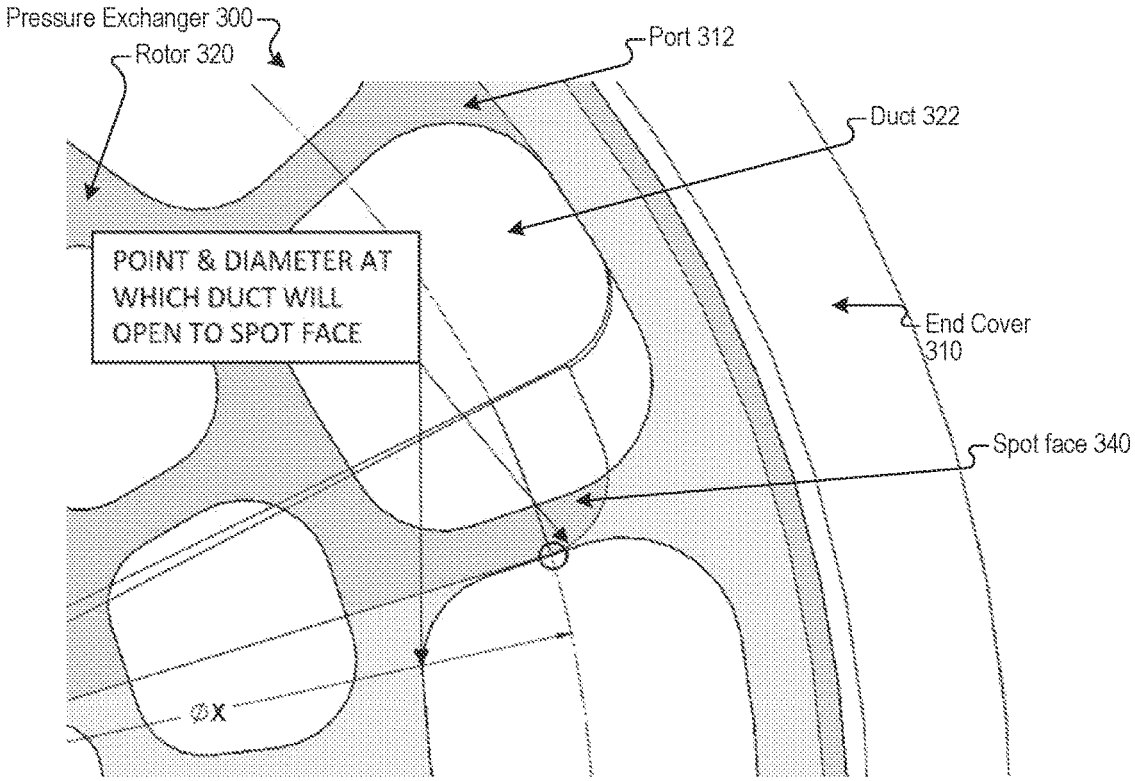

In some embodiments, the first spot face 340 has a radial extent that is shorter than duct radial extent of a corresponding duct 322 formed by the rotor 320 (e.g., see FIGS. 5D-F).

Figure 5G:
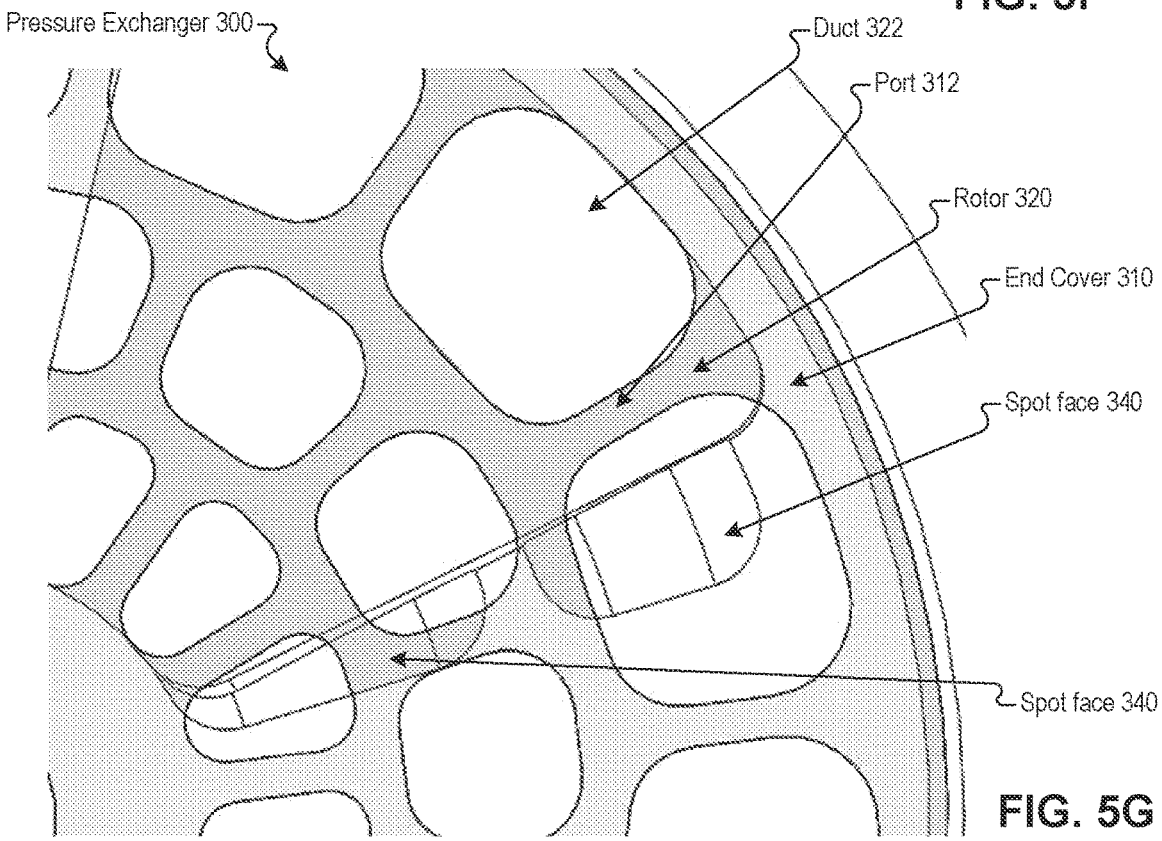

In some embodiments, the first spot face 340 (e.g., split spot face) includes a first recess associated with a first concentric row of the ducts 322 and a second recess associated with a second concentric row of the ducts 322 (e.g., see FIG. 5G).

Figures 5H, 5I:
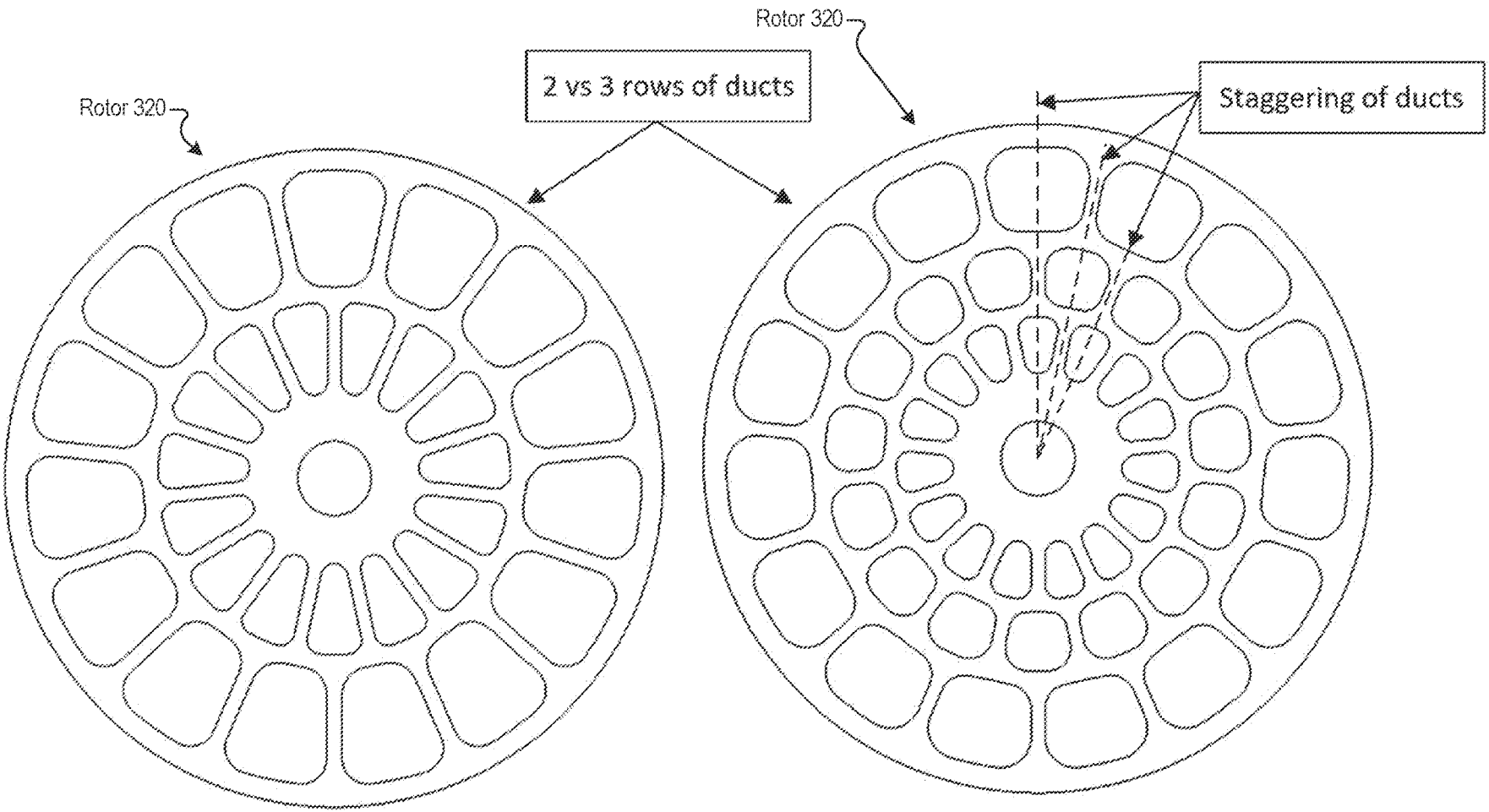

In some embodiments, the rotor 320 forms the ducts 322 in concentric rows that are staggered (e.g., see FIGS. 5H-I).

In some embodiments, duct opening of the rotor 320 to a corresponding end cover spot face is at an inside duct diameter by adjusting angle of spot face edge or curving spot face wall respective to the duct opening.

In some embodiments, the end cover 310 (e.g., that forms LPIN port and HPOUT port) forms a pre-pressurization hole proximate the first spot face 340. The pre-pressurization hole is configured to one or more of pressurize or depressurize at least a portion of the pressure exchanger proximate the end cover 310 (e.g., that forms LPIN port and HPOUT port).

Figure 5J:
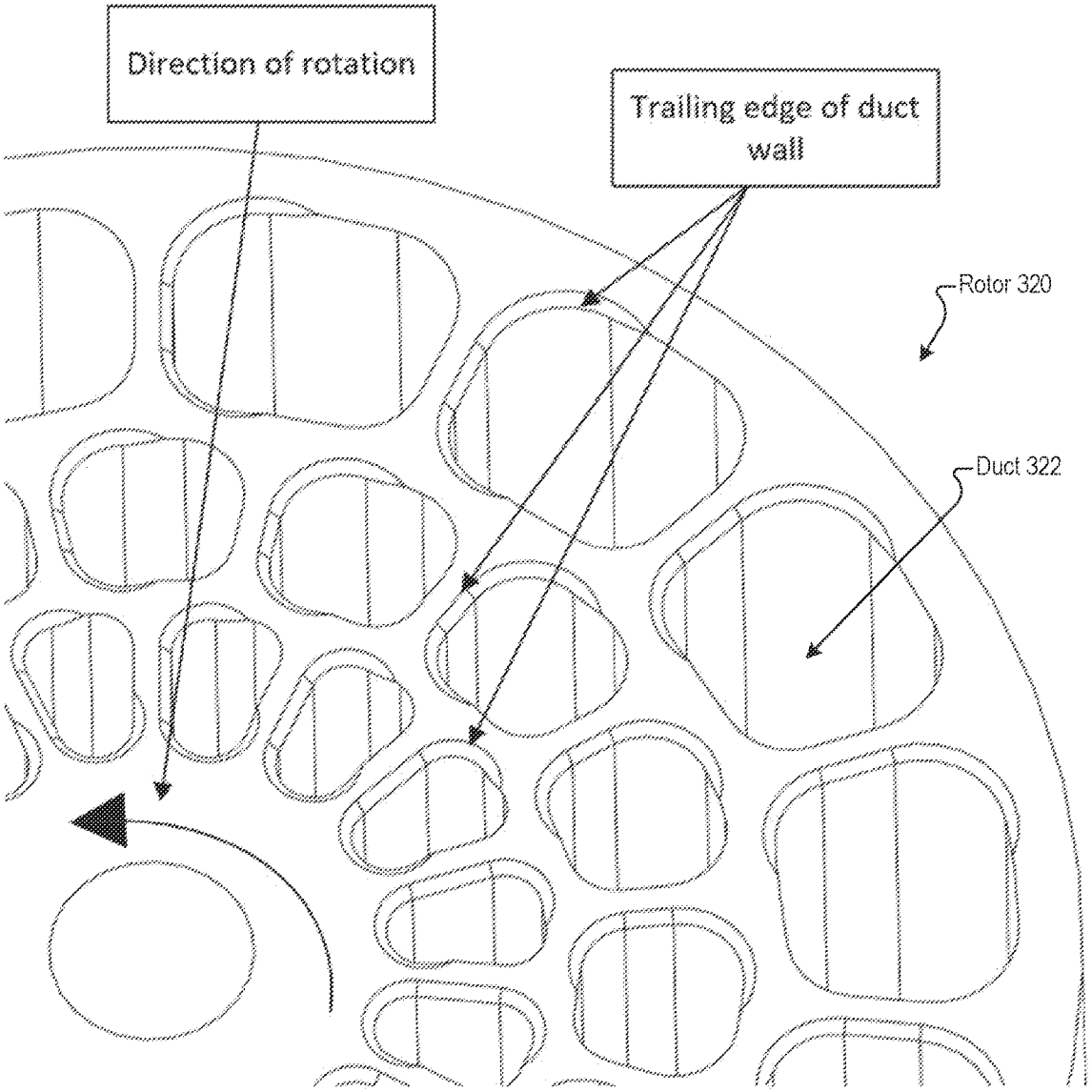

FIG. 5J illustrates a rotor, according to certain embodiments. In some embodiments, the rotor 320 forms chamfers on trailing edge rotor duct walls. Chamfers on trailing edge of rotor duct walls may increase coefficient of discharge (Cd) of rotor 320.

Adding a chamfer or fillet on the trailing edge of a rotor duct wall may increase the effective area (coefficient of discharge) for depressurization jets from the high pressure duct into the low pressure kidney. This increase in effective area reduces the jet velocity and the consequent drop in local fluid static pressure, which may reduce cavitation potential. Similarly, a chamfer or fillet may be employed on the leading edge of a rotor duct wall to increase the effective area (coefficient of discharge) for pressurization jets from the kidney into the duct 322. In some embodiments, these features, by reducing the peak jet velocity, also reduce noise and vibration.

The present disclosure may provide cavitation, noise, and vibration control in a pressure exchanger 300 (e.g., rotary isobaric pressure exchanger).

In a pressure exchanger (e.g., rotary isobaric pressure exchanger), rotating ducts carry high pressure fluids from high pressure kidneys (ports) towards low pressure kidneys and also low pressure fluids from low pressure kidneys to high pressure kidneys. The duct fluids undergo rapid pressurization or depressurization whenever the duct fluids approach a set of kidneys. The frequency and the rate of pressurization and/or depressurization depends on the rotor RPM, the number of pressure exchange cycles per revolution and the pressure differential between HP and LP kidneys. This rapid pressurization and/or depressurization results in high velocity fluid jets generating noise and producing flow and pressure pulsations which increase vibration levels. This can produce vapor bubbles if the local fluid pressure (e.g., due to high velocity of the local fluid pressure) falls below the vapor pressure at that temperature. These vapor bubbles collapse as they travel to higher pressure regions resulting in void formation causing surrounding fluid to rush in producing very high localized pressure spikes. If these occur next to a solid wall, they can produce pitting damage, which accumulates over time. This can cause cavitation which also amplifies the noise and vibration levels.

Spot faces 340 (e.g., channels, notches, recesses) may be used to control the rate of pressurization or depressurization of the rotor ducts 322 and thereby reduce noise, vibration, and risk of cavitation damage. In the present disclosure includes spot faces 340 with increased effectiveness without adversely impacting other performance parameters of the pressure exchanger such as mixing or efficiency.

In some embodiments, pressure exchanger 300 may have a spot face 340 at the LPIN port without having a spot face 340 on LPOUT port.

As a duct 322 carrying high pressure fluids approaches the LPIN and LPOUT ports, the rate of depressurization of the duct fluids can be controlled by incorporating a spot face 340 at the entrance of either LPIN port or at the entrance of LPOUT port or both. LPOUT port pressure is lower than LPIN port pressure due to the viscous and inertial losses in the ducts 322 of rotor 320. In some embodiments (e.g., a typical SWRO plant), while using a pressure exchanger 300 as an energy recovery device, LPOUT pressure can be about half of LPIN pressure. As such, by locating the spot face 340 of a given geometry at LPIN entrance instead of LPOUT entrance, duct depressurization occurs with a lower pressure gradient (e.g., lower jetting velocities) and may result in lower cavitation potential, noise, and vibration levels.

In some embodiments, pressure exchanger 300 includes a spot face 340 at LPIN port (e.g., instead of LPOUT port) and/or at HPOUT port (e.g., instead of HPIN port).

As a duct 322 carrying low pressure fluids approaches the HP ports, the rate of pressurization of the duct fluids can be controlled by incorporating a spot face 340 at the entrance of either HPIN port or at the entrance of HPOUT port or both. HPOUT port pressure is lower than HPIN port pressure due to the viscous and inertial losses in the rotor ducts. As such, by locating the spot face 340 of a given geometry at HPOUT entrance instead of HPIN entrance, duct pressurization occurs with a lower pressure gradient (e.g., lower jetting velocities) and results in lower cavitation potential, noise, and vibration levels.

In some embodiments, ducts 322 open to the spot face 340 at the duct inside diameter (ID) instead of at the duct outside diameter (OD). Fluid in the duct 322 undergoes rotary motion and, as such, the tangential component of the fluid velocity increases linearly with radius. In addition, the fluid pressure within the duct increases from duct ID to OD due to the centrifugal head caused by the centripetal acceleration of the fluid. When a duct carrying high pressure fluids approaches the spot face 340 at the entrance of a low pressure kidney, the depressurization occurs through jetting along the spot face 340 from duct ID instead of duct OD. This can be accomplished by adjusting the relative angle between the spot face 340 and the duct 322 at their approach. This can also be accomplished by curving the duct wall and/or the spot face 340 wall at their approach either towards or away from the duct 322.

In some embodiments, a chamfer at LPIN port (e.g., LPIN open) may change the included angle of spot face 340 for different rows of ducts 322. In some embodiments, the spot face 340 may conform to a duct 322. In some embodiments, spot faces 340 may have a radial extent that is shorter than that of a duct 322. Both the fluid tangential velocity and pressure in rotor ducts may increase with the radial coordinate. A way to prevent jetting and depressurization at the highest radius is by shortening the spot face 340 radial extent (e.g., spot face 340 with lower radial extent that is short than the radial extent of the duct 322).

In some embodiments, an end cover 310 forms split spot faces 340 (e.g., one per row of ducts or combined for a set of rows).

A pressure exchanger 300 may include multiple rows of ducts 322 formed by the rotor 320. Each of the rows may have a different duct geometry resulting in different volumes of fluids that are to be pressurized and/or depressurized. The fluid tangential velocity and pressure may change from one row to another. A spot face 340 tuned for each row of ducts 322 may be more effective at reducing noise, vibration, and cavitation than a single spot face 340 covering all of the rows. In some embodiments, a single spot face 340 is used that has a varied geometry along the radius (e.g., for the ramp angle).

In some embodiments, the duct volume may be optimized (e.g., one or more rows of trapezoidal ducts). In some embodiments, ducts in adjacent concentric rows may be staggered.

Splitting the rotor ducts into multiple rows instead of a single row while keeping the total rotor duct volume substantially the same may result in ducts of smaller size. By staggering the duct rows such that each row of the ducts approaches the kidneys at a different instant allows for depressurization and/or pressurization of a single duct in a single row at a time. This allows for shallower spot face 340 ramp and a reduced pressure gradient across the duct wall.

Staggering the duct rows may result in a more uniform flow and pressures (e.g., minimize individual duct volume) resulting in reduced vibration levels.

In some embodiments, various spot face 340 geometries may be used and may be combined with one or more pre-pressurization or depressurization holes.

In some embodiments, one or more of spot face 340 angular extent, radial extent, and/or ramp may be optimized for different fluids.

The depth, radial, and angular extents of the spot face 340 may depend on the pressure exchanger geometry (e.g., duct size, duct wall thickness, etc.), pressure exchanger flow rate, HP/LP pressure ratio, rotor RPM, type of fluid, etc. In some embodiments, the higher the compressibility of the fluid is, the higher the spot face 340 volume is to be to provide pressurization and/or depressurization of the rotor duct.

The present disclosure may be used to reduce cavitation potential, noise, and/or vibration levels. The present disclosure may use spot faces 340 in addition to reducing RPM, reducing the number of pressure exchange cycles, including pre-pressurization and/or depressurization holes, and/or the like.

The present disclosure may reduce noise generation, vibration levels, and cavitation potential in energy recovery applications using a pressure exchanger.

The present disclosure may be used for use of pressure exchangers for energy recovery such as in SWRO, trans-critical CO2 refrigeration/heat pumps, industrial waste water etc.

The preceding description sets forth numerous specific details, such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about," "substantially," or "approximately" is used herein, this is intended to mean that the nominal value presented is precise within ±10%. Also, the terms "first," "second," "third," "fourth," etc. as used herein are meant as labels to distinguish among different elements and can not necessarily have an ordinal meaning according to their numerical designation.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner. In one embodiment, multiple metal bonding operations are performed as a single step.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which each claim is entitled.

What is claimed is:

1. A pressure exchanger comprising:

a rotor configured to rotate to exchange pressure between a first fluid at a first pressure and a second fluid at a second pressure, wherein the rotor forms ducts that are routed from a first distal end of the rotor to a second distal end of the rotor;

a first end cover disposed at the first distal end of the rotor, wherein the first end cover forms a high pressure in (HPIN) port comprising sidewalls that are at least partially angled and configured to provide the first fluid at the first pressure in a substantially axial direction into the ducts while the rotor is rotating, and wherein the first end cover forms a low pressure out (LPOUT) port configured to receive the first fluid from the ducts at a third pressure that is lower than the first pressure; and a second end cover disposed at the second distal end of the rotor, wherein the second end cover forms a low pressure in (LPIN) port configured to provide the second fluid at the second pressure into the ducts and forms a high pressure out (HPOUT) port configured to receive the second fluid from the ducts at a fourth pressure that is higher than the second pressure, wherein one or more first end cover radial sidewalls are offset relative to one or more second end cover radial sidewalls, and wherein the one or more first end cover radial sidewalls are associated with a same duct as the one or more second end cover radial sidewalls.

2. The pressure exchanger of claim 1, wherein:

the first end cover comprises first radial sidewalls, a first inner sidewall, and a first outer sidewall that form the HPIN port, the first radial sidewalls being disposed between a first center of the first end cover and a first perimeter of the first end cover, the first inner sidewall being proximate the first center of the first end cover, and the first outer sidewall being proximate the first perimeter of the first end cover;

the second end cover comprises second radial sidewalls, a second inner sidewall, and a second outer sidewall that form the HPOUT port, the second radial sidewalls being disposed between a second center of the second end cover and a second perimeter of the second end cover, the second inner sidewall being proximate the second center of the second end cover, and the second outer sidewall being proximate the second perimeter of the second end cover; and the first radial sidewalls of the HPIN port are at least two degrees closer to each other than the second radial sidewalls of the HPOUT port are to each other.

3. The pressure exchanger of claim 1, wherein a leading radial sidewall of the HPIN port is configured to open relative to a corresponding duct of the rotor at least two degrees after a corresponding leading radial sidewall of HPOUT port opens relative to the corresponding duct of the rotor.

4. The pressure exchanger of claim 1, wherein a trailing radial sidewall of the HPIN port closes relative to a corresponding duct of the rotor at least two degrees before a corresponding trailing radial sidewall of the HPOUT port closes relative to the corresponding duct of the rotor.

5. The pressure exchanger of claim 1, wherein one or more radial sidewalls of the LPOUT port are offset relative to the one or more sidewalls of the LPIN port.

6. The pressure exchanger of claim 1, wherein a trailing radial sidewall of the LPIN port closes relative to a corresponding duct of the rotor at least two degrees before a corresponding trailing radial sidewall of the LPOUT port closes relative to the corresponding duct of the rotor.

7. The pressure exchanger of claim 1, wherein a leading radial sidewall of the LPIN port closes relative to a corresponding duct of the rotor at least two degrees before a corresponding leading radial sidewall of the LPOUT port closes relative to the corresponding duct of the rotor.

8. The pressure exchanger of claim 2, wherein:

the first end cover forms a fillet between at least one of the first radial sidewalls and the first inner sidewall; and the fillet of the first end cover is configured to close the HPIN port relative to a corresponding duct of the rotor prior to the HPOUT port of the second end cover closes relative to the corresponding duct.

9. The pressure exchanger of claim 2, wherein:

the first radial sidewalls of the first end cover each form a ramp; and the second radial sidewalls of the second end cover form the HPIN port without forming ramps.

10. The pressure exchanger of claim 2, wherein:

the first radial sidewalls of the first end cover each form a corresponding ramp in a direction of rotation; and the second radial sidewalls of the second end cover form the HPIN port with a respective ramp in the direction of rotation, the first radial sidewalls comprising a leading sidewall and a trailing sidewall on the HPIN port that each have a corresponding ramp angle varying from about 30 degrees to about 70 degrees measured with respect to a face of the rotor.

11. The pressure exchanger of claim 2, wherein leading radial sidewall and trailing radial sidewall on the LPIN port form a ramp in direction of rotation, wherein the ramp has a ramp angle varying from about 30 degrees to about 70 degrees measured with respect to a face of the rotor.

12. The pressure exchanger of claim 2, wherein the first radial sidewalls form non-planar three-dimensional ramps defined by at least two helix at an innermost radius and outermost radius of the port.

13. The pressure exchanger of claim 12, wherein a corresponding ramp of the non-planar three-dimensional ramps is defined by a spiral that has a pitch that is proportional to a radius at which the corresponding ramp is located to reduce incidence.

14. The pressure exchanger of claim 1 further comprising an insert disposed in the HPIN port, wherein the insert is configured to guide flow and to reduce flow incidence at the rotor.

15. The pressure exchanger of claim 1 further comprising an insert disposed in the LPIN port, wherein the insert is configured to guide flow and to reduce flow incidence at the rotor.

16. The pressure exchanger of claim 1, wherein the first end cover forms a first spot face proximate the LPOUT port without forming a spot face at the HPIN port to reduce mixing of corresponding fluid between the HPIN port and the LPOUT port.

17. The pressure exchanger of claim 1, wherein the first end cover forms a second spot face proximate the LPOUT port without forming a spot face at the LPIN port to reduce mixing of corresponding fluid between the LPIN port and the LPOUT port.

18. The pressure exchanger of claim 1, wherein the pressure exchanger is configured to use the second fluid provided via the HPOUT port as bearing fluid and center bore fluid.

19. A pressure exchanger comprising:

a rotor configured to rotate to exchange pressure between a first fluid at a first pressure and a second fluid at a second pressure, wherein the rotor forms ducts that are routed from a first distal end of the rotor to a second distal end of the rotor; and inserts disposed in the ducts to provide a length to diameter ratio of about 5 to about 10; and a first end cover disposed at the first distal end of the rotor, wherein the first end cover forms a high pressure in (HPIN) port configured to provide the first fluid at the first pressure in a substantially axial direction into the ducts, and wherein the first end cover forms a low pressure out (LPOUT) port configured to receive the first fluid from the ducts at a third pressure that is lower than the first pressure; and a second end cover disposed at the second distal end of the rotor, wherein the second end cover forms a low pressure in (LPIN) port configured to provide the second fluid at the second pressure into the ducts and forms a high pressure out (HPOUT) port configured to receive the second fluid from the ducts at a fourth pressure that is higher than the second pressure, wherein one or more first end cover radial sidewalls are offset relative to one or more second end cover radial sidewalls, and wherein the one or more first end cover radial sidewalls are associated with a same duct as the one or more second end cover radial sidewalls.

20. The pressure exchanger of claim 19, wherein the inserts are honeycomb-shaped flow straighteners that are press-fit, shrunk-fit, or glued adhesively into the ducts.

* * * * *